US007051561B2

(12) United States Patent
Moon et al.

(10) Patent No.: US 7,051,561 B2
(45) Date of Patent: May 30, 2006

(54) ELECTRONIC LOCK

(75) Inventors: Charles W. Moon, Colorado Springs, CO (US); Ernst K. Mitchell, Sterling Heights, MI (US); Mohamad A. Khalil, Sterling Heights, MI (US); John J. Kimes, Twin Peaks, CA (US)

(73) Assignee: Computerized Security Systems, Inc., Troy, MI (US)

( * ) Notice: Subject to any disclaimer, the term of this patent is extended or adjusted under 35 U.S.C. 154(b) by 188 days.

(21) Appl. No.: 10/343,553

(22) PCT Filed: Dec. 8, 2000

(86) PCT No.: PCT/US00/33231

§ 371 (c)(1),
(2), (4) Date: Oct. 23, 2003

(87) PCT Pub. No.: WO01/42594

PCT Pub. Date: Jun. 14, 2001

(65) Prior Publication Data

US 2004/0045330 A1 Mar. 11, 2004

Related U.S. Application Data

(60) Provisional application No. 60/169,636, filed on Dec. 8, 1999, provisional application No. 60/190,970, filed on Mar. 22, 2000.

(51) Int. Cl.
*E05B 49/00* (2006.01)

(52) U.S. Cl. ..... 70/283.1; 70/278.1; 70/278.2; 340/5.6; 340/5.64; 340/5.65; 340/5.66; 340/5.67; 361/172

(58) Field of Classification Search ..... 70/275, 70/277–283.1; 361/172; 340/825.31, 825.32, 340/825.34, 562

See application file for complete search history.

(56) References Cited

U.S. PATENT DOCUMENTS

| | | | | |
|---|---|---|---|---|
| 4,633,687 | A * | 1/1987 | Fane | 70/276 |
| 4,848,115 | A | 7/1989 | Clarkson et al. | |
| 4,990,758 | A | 2/1991 | Shibano et al. | |
| 5,204,663 | A * | 4/1993 | Lee | 340/5.28 |
| 5,437,174 | A | 8/1995 | Aydin | |
| 5,474,348 | A | 12/1995 | Palmer et al. | |
| 5,608,298 | A * | 3/1997 | Frolov et al. | 318/286 |
| 5,791,177 | A | 8/1998 | Bianco | |
| 5,816,083 | A | 10/1998 | Bianco | |
| 5,923,264 | A * | 7/1999 | Lavelle et al. | 340/5.64 |

* cited by examiner

*Primary Examiner*—Suzanne Dino Barrett
(74) *Attorney, Agent, or Firm*—Reising, Ethington, Barnes, Kisselle, P.C.

(57) ABSTRACT

A mortise lockset apparatus (10) that includes a retractable bolt (20) movably supported within a case (12). A handle (18) is pivotally supported on a hub (16) supported in the case, the hub being operably connected to the retractable bolt. The bolt is retracted by turning the door handle. A lock-out mechanism (22) is configured to prevent the handle from being turned when the lock-out mechanism is in an engaged position. The handle lock-out mechanism also includes a cam (29) movably supported in the case and operably connected to a motor (30). A sliding stop (34) is movably supported in the case and is engageable with the handle hub to prevent the handle hub and the handle from turning. The sliding stop is also engageable with a cam surface (40) of the cam. The motor is configured to move the sliding stop by rotating the cam. The cam rotational axis (42) is disposed between diametrically opposed portions of the cam surface to minimize space requirements for the assembly.

22 Claims, 22 Drawing Sheets

98
14
12
29
44
46
48
40
32
30
82
80
36
88
34
38,90
22
24
20
16
102

10
122
124
131
126
129
128
116
104
108
106
112
110
78
28,76
19
100
128
129
124
131
128
126
94,140,160
123
26
208
136
134
210
120
118
114
18
123

302
304
350
352
354
LOW POWER OSCILLATOR
REAL TIME CLOCK
ADDRESS DATA
ADDRESS STROBE
DATA STROBE
WRITE ENABLE
CHIP ENABLE
CLOCK
SQUARE WAVE OUTPUT
INTERRUPT REQUEST
360
362
364
366
CLOCK
RTC SIGNAL
ADDRESS DATA
RTC ADDRESS ENABLE
RTC READ CONTROL
RTC WRITE CONTROL
RTC CHIP SELECT

ELECTRONIC LOCK

REFERENCE TO PROVISIONAL PATENT APPLICATION

This application claims the benefit of Provisional Patent Applications U.S. Ser. Nos. 60/190,970 filed Mar. 22, 2000 and 60/169,636 filed Dec. 8, 1999.

TECHNICAL FIELD OF THE INVENTION

This invention relates generally to an electronic mortise lockset for mounting in a door and more particularly to such an electronic lock having a motorized handle lock-out feature and an electronic lockset controller for reading various types of key cards and controlling the mortise lockset accordingly.

INVENTION BACKGROUND

Mortise locksets usually include handles that are operably connected to retractable latch bolts by latch bolt retraction mechanisms. A typical mortise lockset includes a generally rectangular case that fits into a similarly-shaped complementary cavity formed or cut into a door. The retractable latch bolt and the retraction mechanism are supported within the case with a portion of the latch bolt extending from the case in an extended position. In the extended position the latch bolt engages a complementary recess formed in a door jam when the door is closed. When an operator turns the door handle the retraction mechanism causes the latch bolt to retract from the door jam recess into a retracted position in the mortise lockset case. With the latch bolt in the retracted position, the door is free to move from the closed position to an open position.

Most such mortise locksets also include some form of lock-out mechanism that is positioned to mechanically engage either the handle, the latch bolt or some portion of the retraction mechanism. Such lock-out features are usually mounted in the mortise lockset case and are configured to prevent the latch bolt from being retracted and/or the handle from being turned without first unlocking the locking mechanism by inserting a key or by entering some type of coded entry command on a keypad.

An example of a mortise lockset having a handle lock-out mechanism that prevents a handle portion of the lockset from being moved without first inserting a key or key card is disclosed in U.S. Pat. No. 5,474,348 issued Dec. 12, 1998 to Palmer et al. (the Palmer patent). This patent shows an electronic lock having a door handle lock-out feature that includes a motor-driven cam that moves a sliding stop into engagement in a hub to lock the hub in place. A slip clutch mechanism allows the motor to continue running after the sliding stop has been driven to the full extent of its travel into the hub. The motor is set to run for slightly longer than required to ensure that the slider is fully engaged in the hub. The door handle lock-out feature also includes a spring that stores energy when the sliding stop is either blocked or hung up by friction as it is being moved. When the blockage or hangup is overcome, the stored spring energy moves the sliding stop into the commanded position. A gearbox is connected between the motor and the cam to allow the motor to run at high speed.

The cam disclosed in the Palmer patent is a locking bar type cam with cam surfaces disposed at the end of an elongated spring arm. The motor moves the spring arm and cam surfaces through a short arc. The slip clutch mechanism disclosed in the Palmer patent is located in a pivoting hub that supports the spring arm. The run time of the motor disclosed in the Palmer patent is preset to produce one full 360° rotation.

The Palmer motor pivots the cam surfaces through an arc at the end of an elongated arm mounted on a pivot hub that includes the slip clutch. Therefore, along with the pivot hub, the cam requires a considerable amount of space within the lock case both for installation and for movement in operation. The elongated spring arm is also prone to bending, i.e., plastic deformation. Because the motor run time is preset to a constant value the Palmer lock is unable to extend battery life by limiting motor run time. The Palmer lock is also unable to determine when the sliding stop is fully engaged. The Palmer lock is also unequipped to easily adapt to applications where it may be necessary or desirable to lock-out the interior handle rather than the exterior handle.

Some electronic mortise locksets also include deadbolt position indicators that transmit deadbolt position information to the logic circuitry of the lock. For example, U.S. Pat. Nos. 5,791,177 and 5,816,083 issued to Bianco (the Bianco patents) show a controller that receives a deadbolt position indicating signal through sensors mounted on a printed circuit board. A spindle turns a communication plate which actuates the sensors. The communication plate is configured to close electrical circuits when contacting the sensors.

Some electronic mortise locksets include employee access tracking systems that help employers determine and keep track of which of their employees have gained access to which rooms in an establishment such as a hotel or office building. For example, U.S. Pat. No. 5,437,174 to Aydin (the Aydin patent) and the Bianco patents disclose electronic locks that download entry data onto key cards. The information stored on the cards includes the times and dates that the lock has been opened. However, the Aydin and Bianco locks are unable to provide a record of entry on each user's card.

Most electronic mortise locksets include some form of card reader module configured to read bar code symbols printed on key cards, magnetic strips affixed to key cards and/or to communicate with integrated circuit chips (IC chips) embedded on so-called "smart" key cards. For example, U.S. Pat. No. 4,990,758 issued Feb. 5, 1991 to Shibano et al. (the Shibano patent) shows a snap-together card reader module including a magnetic reader. Locking snaps hold the module together. A spring biases the magnetic read head against a card that is inserted into the reader module. While the Shibano lockset offers the ease of snap-together construction, it lacks dual-function components that could further simplify its assembly and operation.

Electronic locks have been designed that are both programmable and interrogatable. For example, U.S. Pat. No. 4,848,115 issued to Clarkson et al. (the Clarkson patent) shows a lock programmer including a serial port cable connected to a key. A user may insert the key into a card reader module to program a lock. However, the Clarkson lock programmer cannot be used to interrogate a lock or to apply power to the lock.

What is needed is an electronic mortise lockset handle lock-out mechanism that is more robust, requires less space within the lockset case and that can extend battery life by limiting motor run time while insuring full engagement of the lock-out mechanism. What is also needed is an electronic mortise lockset that includes: a deadbolt position indicator that does not require that open-air electrical contact be made between a metal plate and wire sensors; an employee access tracking system that provides a record of entry on each user's key card; a card reader module that can read more than one type of key card and that is easier to assemble; and that includes a lock programmer capable of performing other operations in addition to lock programming.

INVENTION SUMMARY

In accordance with this invention a mortise lockset apparatus for a door mounted in a door frame is provided. The apparatus includes a case configured to fit into a complementary cavity in a door and a retractable bolt movably supported within the case. A portion of the bolt extends from the case in an extended position and is withdrawn into the case in a retracted position. The bolt is configured to engage a complementary recess formed in a door frame when the bolt is in the extended position and the door is in a closed position with the bolt axially aligned with the recess. A handle is pivotally and rotatably mounted on a hub supported in the case, the hub being operably connected to the retractable bolt. The bolt is retractable from the extended position by turning the door handle. A lock-out mechanism is supported in the case and is configured to prevent the handle from being turned when the lock-out mechanism is in an engaged position. A key reader is supported adjacent the case and is connected to the lock-out mechanism. The key reader is configured to identify properly configured keys. A lockset controller is connected to the lock-out mechanism and the key reader. The lockset controller is configured to disengage the handle lock-out mechanism when the key reader identifies a properly configured key. The handle lock-out mechanism includes a cam movably supported in the case and operably connected to a motor. The handle lock-out mechanism also includes a sliding stop that is movably supported in the case and includes a first end engageable with the handle hub to prevent the handle hub and the handle from turning. The sliding stop includes a bearing surface engageable with a cam surface of the cam, the cam surface being disposed adjacent the bearing surface of the sliding stop in a position to move the sliding stop into engagement in the hub when the motor moves the cam, to lock the hub in place. The motor is configured to move the cam surface about a cam axis. The cam is rotatably supported in the case about the cam axis and the cam rotational axis is disposed between diametrically opposed portions of the cam surface to minimize space requirements for the assembly. Because the cam rotational axis is disposed between diametrically opposed portions of the cam surface, the handle lock-out mechanism of the present invention requires less space within the case than prior art lock-out mechanisms. The handle lock-out mechanism further includes a slip clutch disposed between the motor and the cam surface. The slip clutch is configured to allow the motor to continue running after the sliding stop has been driven to the full extent of its travel into the hub.

According to another aspect of the invention, the slip clutch of the lock-out mechanism is disposed between diametrically opposed portions of the cam surface to minimize space requirements for the assembly in the case.

According to another aspect of the invention the lock-out mechanism includes a motor controller configured to run the motor longer than is normally required to move the sliding stop into engagement with the hub to ensure that the sliding stop is frilly engaged in the hub.

According to another aspect of the invention the motor controller is configured to control motor run time as a function of battery charge level, to sense battery voltage in the battery that powers the motor and to limit motor run time in response to battery low voltage conditions, and to calculate a minimum motor run time as a function of the amount of voltage remaining in a battery.

According to another aspect of the invention the lock-out mechanism includes a current increase sensor connected to the motor controller and configured to sense a current increase when the clutch slips. The motor controller is configured to stop the motor when the motor controller senses the current increase.

According to another aspect of the invention the lock-out mechanism includes a spring configured to store energy when the sliding stop is either blocked or hung up by friction as it is being moved, the spring being configured to move the sliding stop into the commanded position when the blockage or hangup is overcome.

According to another aspect of the invention the lock-out mechanism includes a reversible hub configured to be axially reversed.

According to another aspect of the invention the lockset controller is further configured to detect lock malfunctions and to require two key insertions before moving the lock-out mechanism out of the engaged position when the lockset controller has detected a lock malfunction.

According to another aspect of the invention the lockset controller is connected to the motor controller and the lockset controller signals the motor controller to actuate the motor to retract the sliding stop from the hub in response to the second of two key insertions within a predetermined time period when the lockset controller detects a lock malfunction.

According to another aspect of the invention the lockset includes a display panel connected to the lockset controller and the lockset controller is configured to display a code on the display panel that identifies the lock malfunction.

According to another aspect of the invention a lever is pivotally supported on a spindle supported in the case and the spindle is operably connected to the retractable dead bolt. The dead bolt is retractable from the extended position by turning the lever. A dead bolt position indicator includes a microswitch mounted on a printed circuit card and actuated by contact with the spindle as the spindle is rotated. The microswitch is configured to transmit dead bolt position information to the lockset controller. The dead bolt position indicator further includes a cam supported on the spindle and configured to mechanically actuate the microswitch when the dead bolt moves into or out of its engaged position.

According to another aspect of the invention the logic circuitry of the lockset controller is disposed on the printed circuit card.

According to another aspect of the invention lock mounting fasteners connect an inner portion of the lock disposed on an inner side of the door to an outer portion of the lock disposed on an outer side of the door, the inner portion of the lock covering the complementary cavity. A washer plate is disposed on the inner side of the door between the inner portion of the lock and a head portion of each lock mounting fastener. The washer plate includes openings for receiving respective shaft portions of each fastener. The openings are smaller than the head portions of the fasteners. The washer plate comprises a material relatively more fire resistant than the outer portion of the lock.

According to another aspect of the invention the key reader module includes an upper module component defining an upper wall of a key receptacle. A lower module component is connected to the upper module component and defines a lower wall of a key receptacle. Snap-lock detents are supported on at least one of the upper and lower module components and are configured to connect the upper and lower module components together by snap-fit engagement.

According to another aspect of the invention the key reader module comprises an LED bar configured to display information related to lock operation.

According to another aspect of the invention snap-lock detents are supported on at least one of the upper and lower module components and the LED bar and are configured to connect the LED bar to one of the upper and lower module components by snap-fit engagement.

According to another aspect of the invention the LED bar is configured to clamp a flex cable in place when the LED bar is snapped into position on the module.

According to another aspect of the invention the key reader module is configured to read magnetic strips affixed to key cards.

According to another aspect of the invention the key reader comprises a read head bracket assembly including a magnetic read head configured to read magnetic strips affixed to key cards, and a biasing spring that biases the magnetic read head in such a way as to hold the read head bracket assembly together.

According to another aspect of the invention a leg of the key reader biasing spring is positioned to touch a grounded metal portion of the lockset to provide ground for the read head.

According to another aspect of the invention the key reader module is configured to read bar code symbols printed on key cards.

According to another aspect of the invention the key reader module is configured to communicate with integrated circuit chips embedded on key cards.

BRIEF DRAWING DESCRIPTION

To better understand and appreciate the invention, refer to the following detailed description in connection with the accompanying drawings.

DETAILED DESCRIPTION

Figure 1:
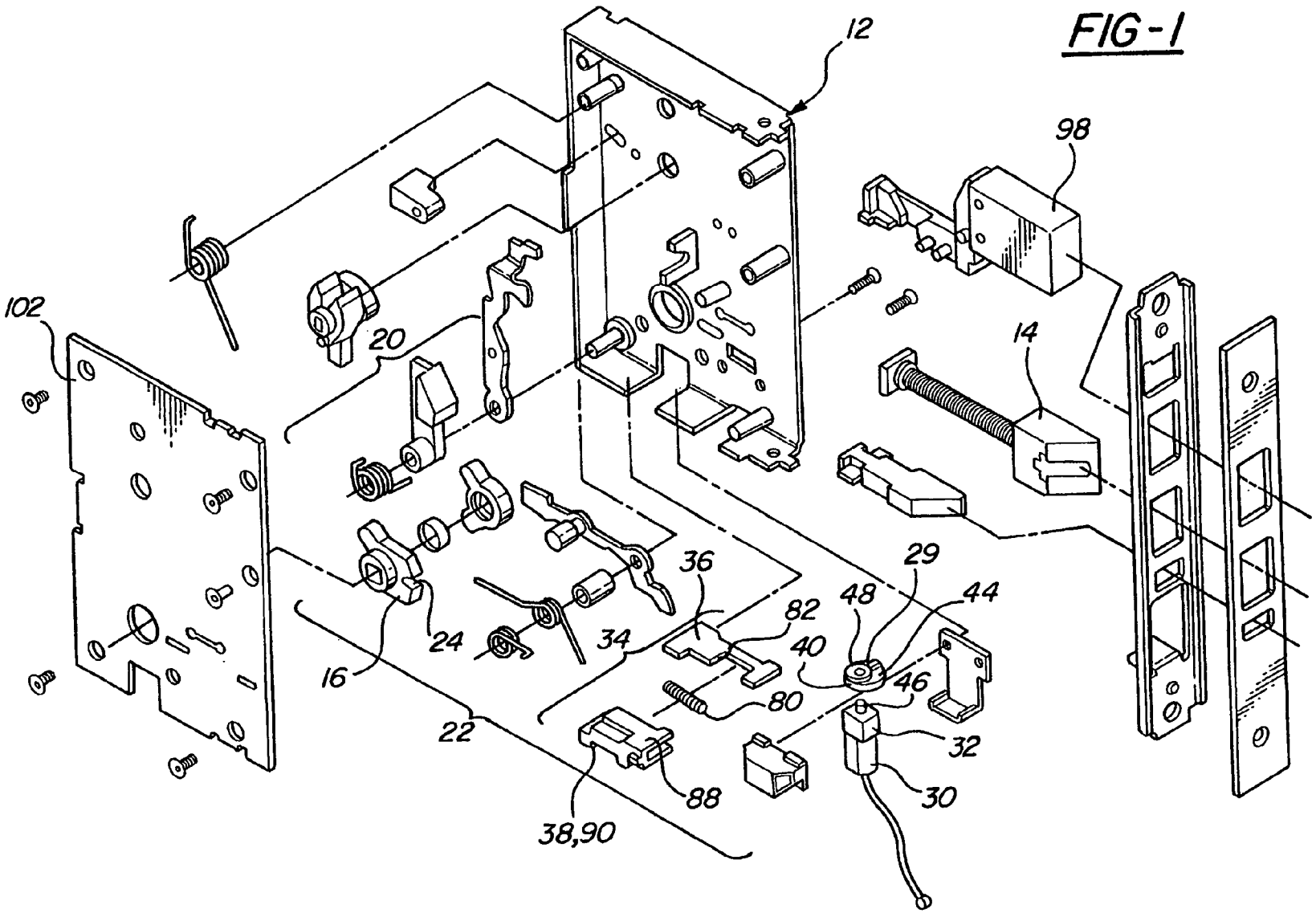
FIG. 1 is an exploded perspective view of a mortise lockset case constructed according to the invention.
Figure 2:
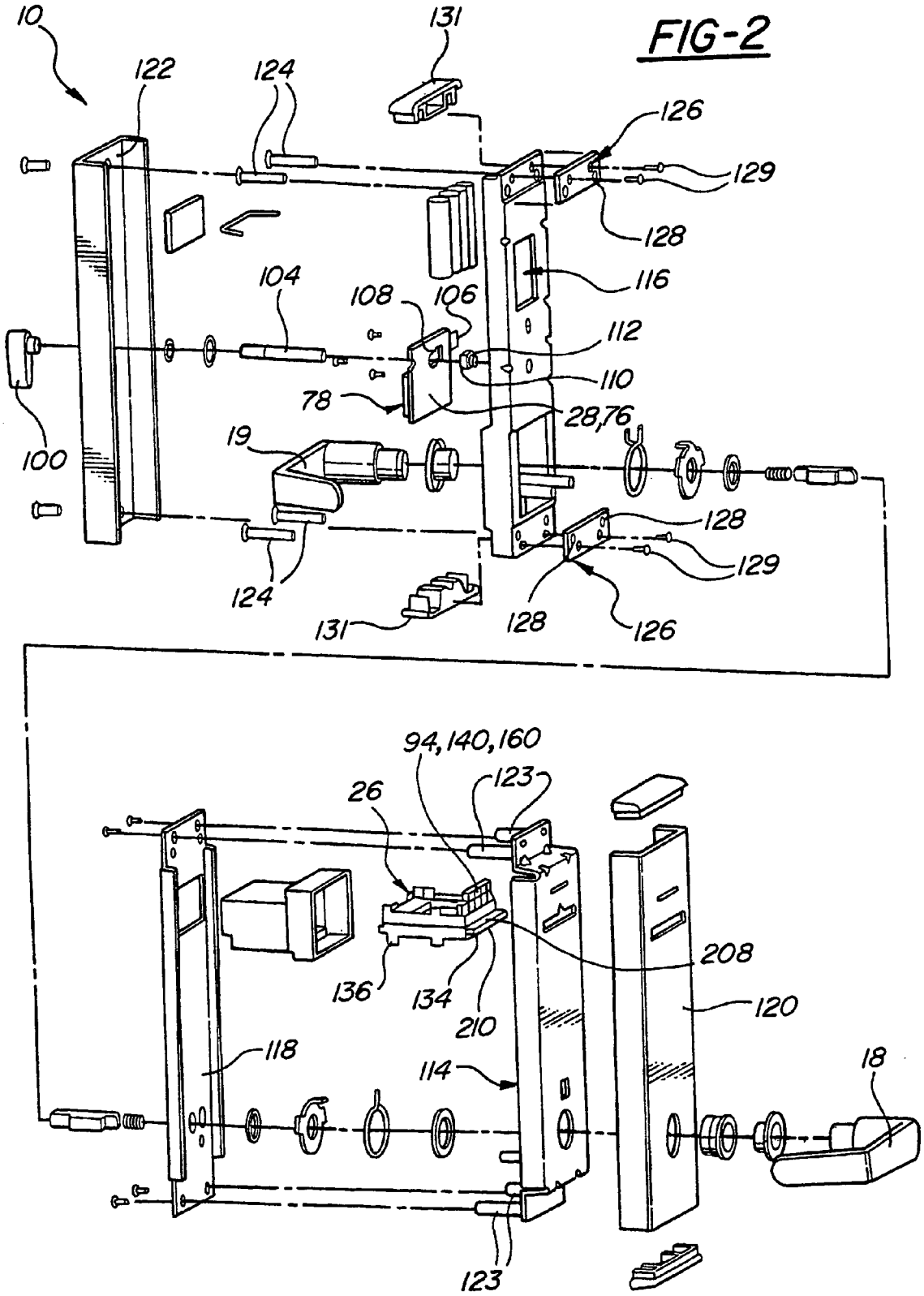
FIG. 2 is an exploded perspective view of an electronic lock constructed according to the invention with the lockset case of FIG. 1 removed for clarity.
Figure 3:
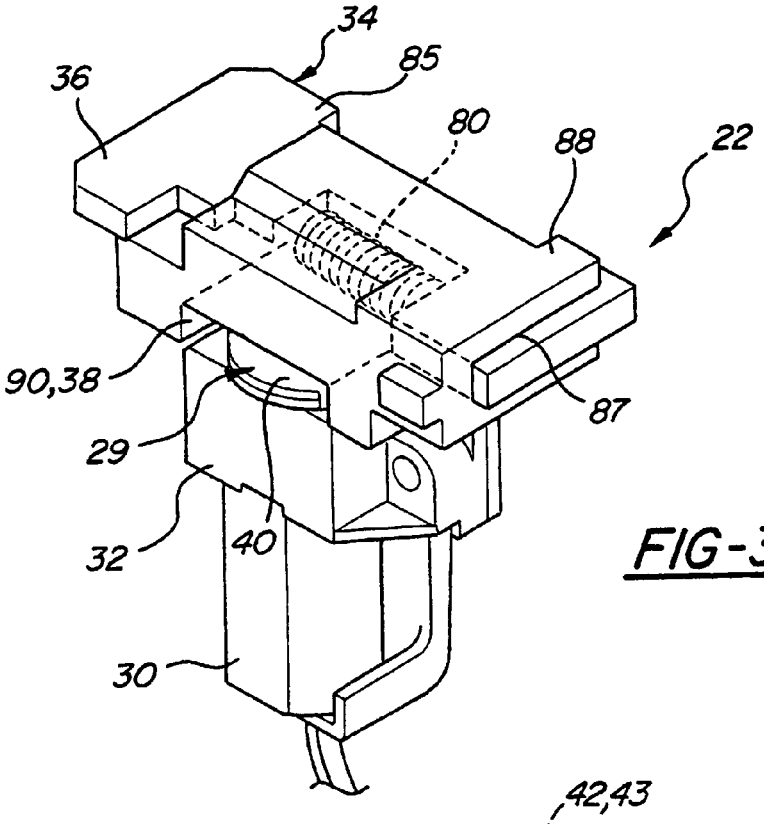
FIG. 3 is an assembled perspective view of sliding stop, cam, gearbox and motor components of the mortise lockset case of FIG. 1.
Figure 4:
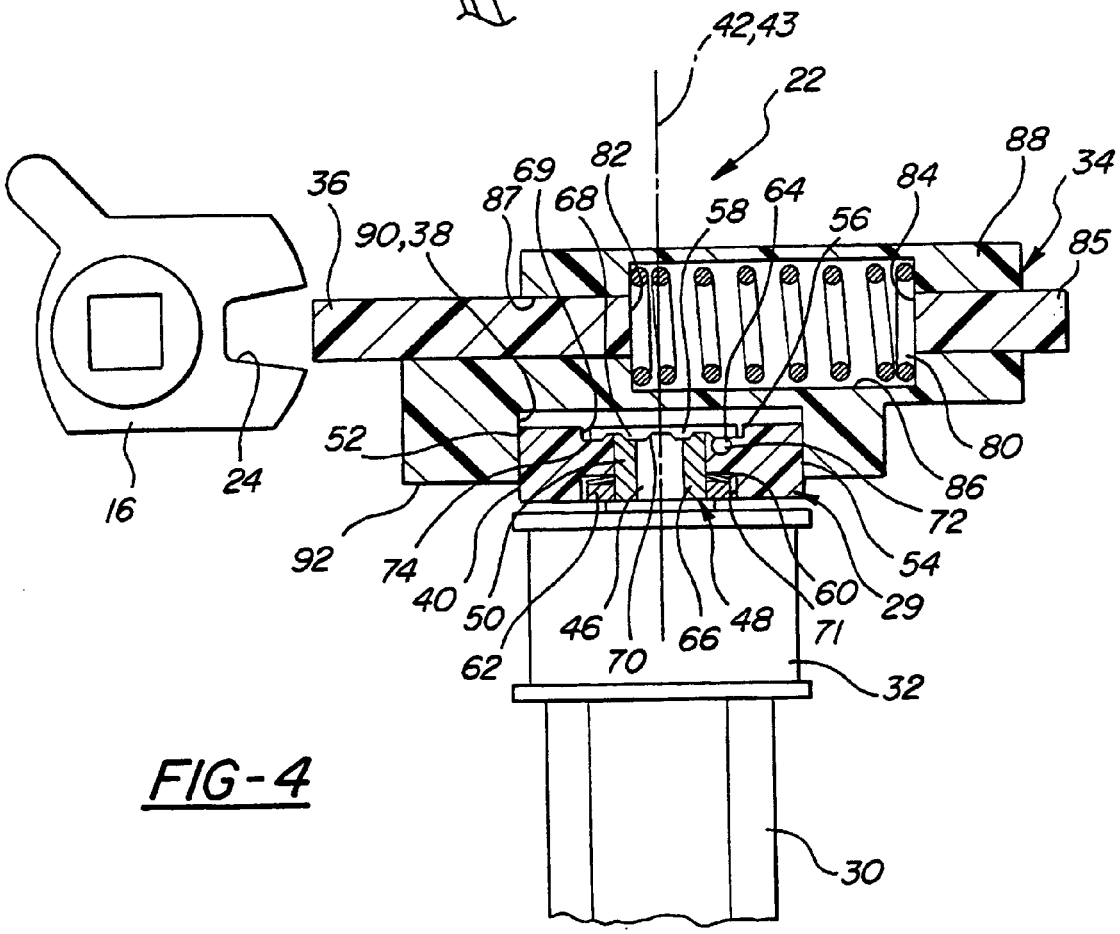
FIG. 4 is a partial cross-sectional front view of hub, sliding stop, cam, clutch, gearbox and motor components of the mortise lockset case of FIG. 1 with the sliding stop disengaged from the hub.

An electronic mortise lockset apparatus constructed according to the invention is generally shown at 10 in FIG. 2 and is adapted for installation in a door mounted in a doorframe. The lockset apparatus includes a generally rectangular mortise lockset apparatus case generally indicated at 12 in FIG. 1. The lockset apparatus case 12 is configured to fit into a similarly shaped complimentary cavity cut into or formed in a door. A detailed description of suitable lockset apparatus components that may be included in the lockset case 12 in addition to those described below can be found in U.S. Ser. No. 08/846,842 (now U.S. Pat. No. 5,820,177 which is incorporated herein by reference).

The lockset apparatus 10 also includes a retractable latch bolt 14 that is movably supported within the lockset case 12. A portion of the latch bolt 14 extends from the case 12 when the latch bolt is in an extended position and is withdrawn into the lockset case when the latch bolt is in a retracted position. The latch bolt 14 is configured and positioned to engage a complimentary recess formed in a doorframe and/or a metal plate fastened to the doorframe. The latch bolt 14 engages the recess when the latch bolt is in the extended position and the door is in a closed position with the latch bolt axially aligned with the recess.

A handle hub 16 is pivotably supported in the lockset case 12 and a handle 18 is operably connected to and at partially supported on the handle hub. The handle hub 16 is operably connected to the retractable latch bolt 14 through a latch bolt retraction mechanism 20. The latch bolt 14 is retractable from the extended position by turning the door handle 18. The retraction mechanism 20 causes the latch bolt 14 to retract from the door jam recess into a retracted position in the lockset case 12. With the latch bolt 14 in the retracted position the door is free to move from the closed position to an open position.

The mortise lockset apparatus 10 also includes a motor-driven door handle lockout mechanism 22 that includes the mortise components generally indicated at 22 in FIGS. 1 and 3–6. These lockout mechanism 22 components are supported in the lockset case 12 and are configured to prevent the handle 18 from being turned and the latch bolt 14 from being retracted when the lock-out mechanism is in an engaged position unless the lockout mechanism is first unlocked by inserting a properly configured key card. Absent the insertion of a properly configured key card, the lockout mechanism 22 of the lockset apparatus 10 will mechanically block the handle 18 from turning.

While the present lockset apparatus embodiment 10 is configured to receive and to be unlocked by a key card, other embodiments may include a locking mechanism configured to receive and be unlocked by insertion and rotation of a standard mechanical key. Still other embodiments may include a keypad configured to allow an operator to unlock the lockset apparatus 10 by entering a coded entry command.

The lockout mechanism 22 prevents the handle 18 from turning by engaging a recess 24 in the handle hub 16. In other embodiments, however, the lockout mechanism 22 may be configured to block the handle 18 from turning by engaging a portion of the retraction mechanism 20 other than the handle hub 16, or by engaging some portion of the handle 18 itself.

As is generally indicated in FIG. 2, a key card reader module 26 is supported above the lockset case 12 and is coupled to the lockout mechanism 22, via lockset controller 28, as will be subsequently explained. The key card reader module 26 is configured to signal the lockout mechanism 22 to disengage only after receiving and identifying a properly configured key card. More specifically, the key card reader module 26 is configured to receive read-writeable "smart" key cards that each include a programmable integrated circuit chip. The integrated circuit chip in each such smart card includes a processor, random access memory (RAM) and read-only memory (ROM). The ROM portion of the integrated circuit chip includes a predetermined program code, as will also be subsequently explained.

The handle lockout mechanism 22 includes a rotary cam 29 movably supported in the case lockset 12 and operably connected to an electric motor 30 through a gearbox 32. The gearbox 32 is configured to reduce output speed. The gearbox 32 is operably connected between the motor 30 and the rotary cam 29 to allow the motor to run at high speed while driving the rotary cam at a low speed.

A sliding stop, generally indicated at 34 in FIGS. 1 and 3–6, is movably supported in the lockset case 12 and includes a first end 36 that engages the handle hub 16 to prevent the handle hub and the handle 18 from turning. The sliding stop 34 also includes a bearing surface 38 that is positioned and configured to engage a bearing surface 40 of the rotary cam 29.

The rotary cam 29 has a cam rotational axis 42 that extends through the rotary cam between diametrically opposite portions 52, 54 of the bearing surface 40 of the rotary cam. This rotary cam design minimizes space requirements for the lockset apparatus 10 in the lockset case 12. The rotary cam 29 has a generally circular disk shape and a radially-extending "lobe" 44 of the rotary cam is formed by supporting the rotary cam on a rotational cam axis 42 that is eccentric, i.e., displaced from and parallel to a center axis 43 of the cam. In other words, the portion of the rotary cam 29 that extends farthest, in a radial direction, from the rotational axis 42 is the cam lobe 44.

The rotary cam 29 is positioned in the lockset case 12 such that its bearing surface 40 is disposed adjacent the second end of the sliding stop 34 in a position to move the sliding stop 34 when the motor 30 turns the rotary cam. The motor 30 turns the rotary cam 29 about the eccentric rotational axis 42 thus moving the bearing surface 40 of the rotary cam and the cam lobe 44 about the rotational axis. The rotary cam 29 is rotatably supported in the lockset case 12 about the rotational axis 42 on a drive shaft 46 that extends from the gearbox 32.

When the motor 30 is activated and rotates the rotary cam 29 through reduction gears supported in the gearbox 32, the bearing surface 40 of the rotary cam rotates and the cam lobe 44 driving the sliding stop 34 into engagement with the handle hub 16. When the handle hub 16 is locked in place by the sliding stop 34, it prevents the door handle 18 from being moved and prevents the latch bolt 14 from being withdrawn. To minimize bearing surface wear caused by sliding contact with the sliding stop 34, the rotary cam 29 is made of an acetal resin such as DuPont Delrin®.

The lockout mechanism 22 also includes a slip clutch 48 disposed between the motor 30 and the bearing surface 40 of the cam 29. The slip clutch 48 allows the motor 30 to continue running after the sliding stop 34 has been driven to the full extent of its travel into the complementary recess in the handle hub 16. The slip clutch 48 is an annular disk-shaped device disposed coaxially within a complementary circular aperture 50 in the rotary cam 29 body between diametrically opposed portions of the bearing surface 40 of the rotary cam. In other words, the rotary cam 29 body is supported around an outer rim of the slip clutch 48 that rotates around the rotational axis 42. The slip clutch 48 is disposed within the rotary cam 29 body to minimize space requirements for the lockset apparatus 10 in the lockset case 12. Because the slip clutch mechanism is disposed coaxially within the rotary cam 29 body, the rotary cam and slip clutch take up less space within the lockset case 12, both for installation and for movement in operation, than they would if they were supported separately.

The slip clutch 48 includes a plastic driver spool 58, a metal crescent washer 60 or "spring" washer 60, an annular plastic retainer flange 62 and three metal balls 64. The driver spool 58 includes a tubular shank 66 and an annular integral flange 68 that extends radially outward from around an upper end of the shank 66. The rotary cam 29 includes an upper counterbore 69 formed around the circular aperture 50 that is shaped to receive the annular flange 68 of the driver spool 58. The integral flange 68 includes twelve radially-spaced detents 70 formed into an underside surface of the integral flange 68. The detents 70 are positioned to rotate in and out of engagement with the three metal balls 64 supported in three respective pockets formed into radially-spaced points around an annular floor surface of the upper counterbore 69 formed into the rotary cam 29 surrounding the circular aperture 50. The retainer flange 62 is configured to be force fit over a lower end of the driver spool 58 shank 66 to hold the rotary cam 29 on the slip clutch 48. The rotary cam 29 includes a lower counterbore 71 formed around the circular aperture 50 to receive the retainer flange 62. The crescent washer 60 is supported around the shank 66 and between the retainer flange 62 and a bottom surface of the rotary cam 29. In this position the crescent washer 60 biases the retainer flange 62, shank 66 and integral flange 68 downward. The biasing force urges the detents 70 into engagement with the three metal balls 64 which causes the rotary cam 29 to rotate with the slip clutch 48. However, the driver spool 58 and integral flange detents 70 can move upwards against the biasing if sufficient force is applied to cause the slip clutch 48 to "hop" over the metal balls 64. This allows the motor 30 to continue turning the driver spool 58 when the rotary cam 29 rotation is impeded.

Figure 5:
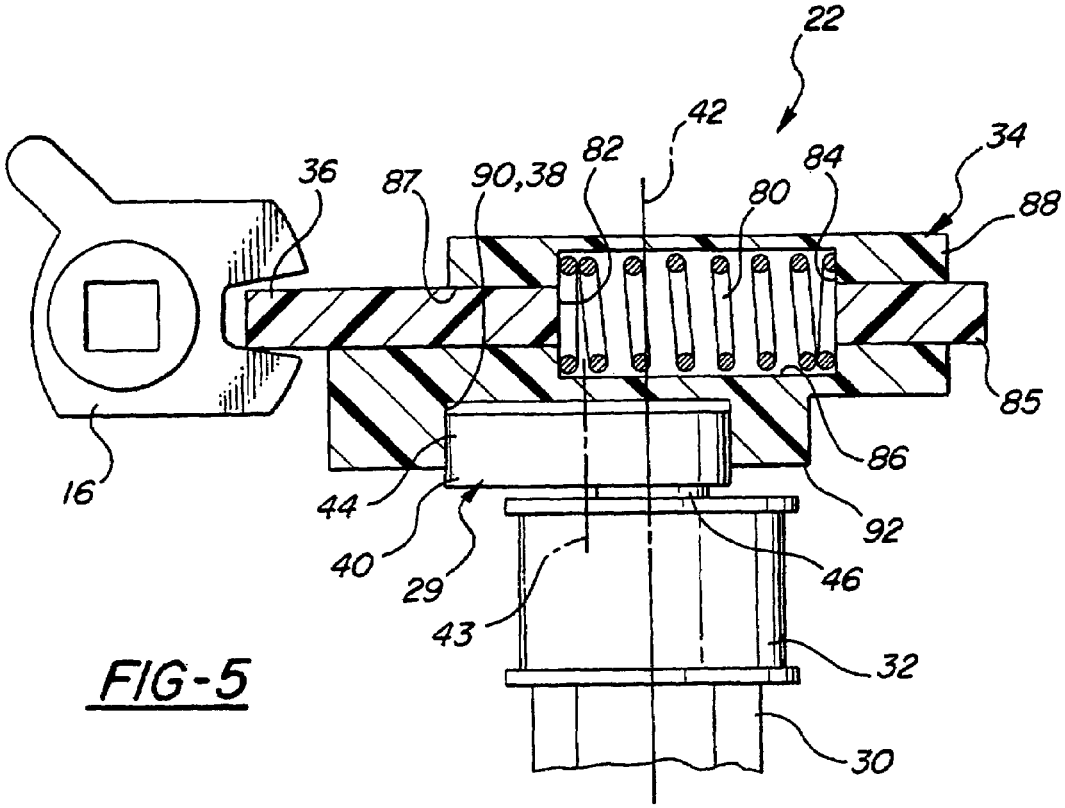
FIG. 5 is a partial cross-sectional front view of hub, sliding stop, cam, clutch, gearbox and motor components of the mortise lockset case of FIG. 1 with the sliding stop engaging the hub.
Figure 6:
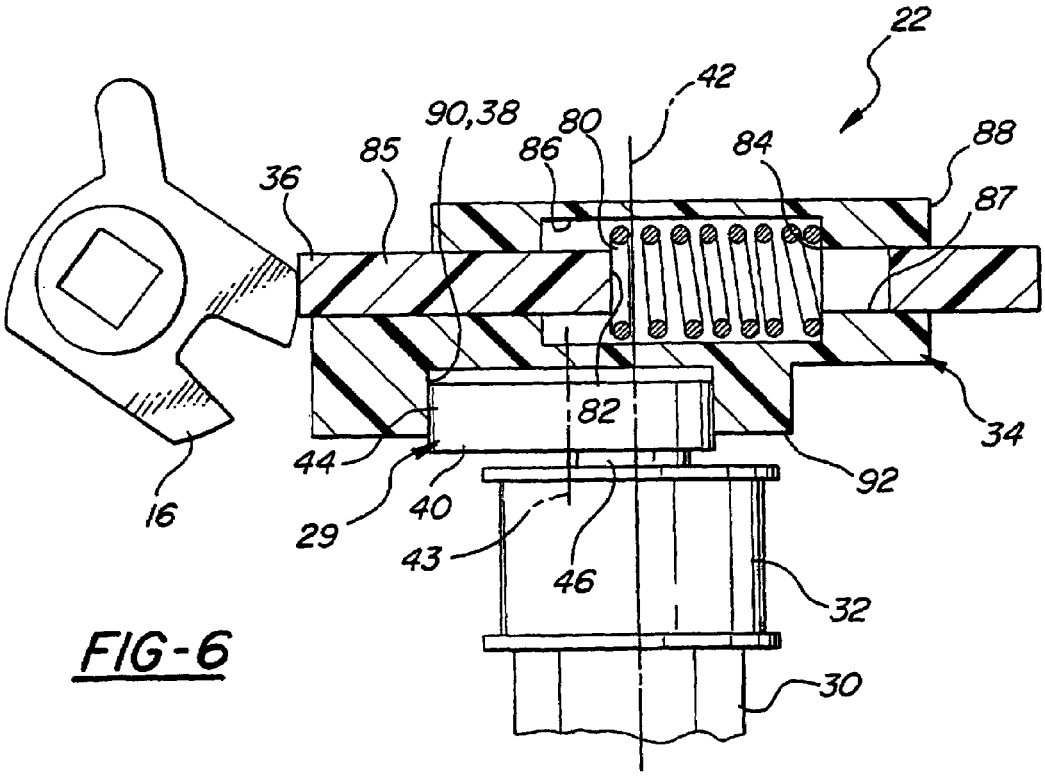
FIG. 6 is a partial cross-sectional front view of hub, sliding stop, cam, clutch, gearbox and motor components of the mortise lockset case of FIG. 1 with the cam positioned to engage the sliding stop, but with the sliding stop disengaged from the hub and a spring component of the sliding stop compressed.
Figure 7:
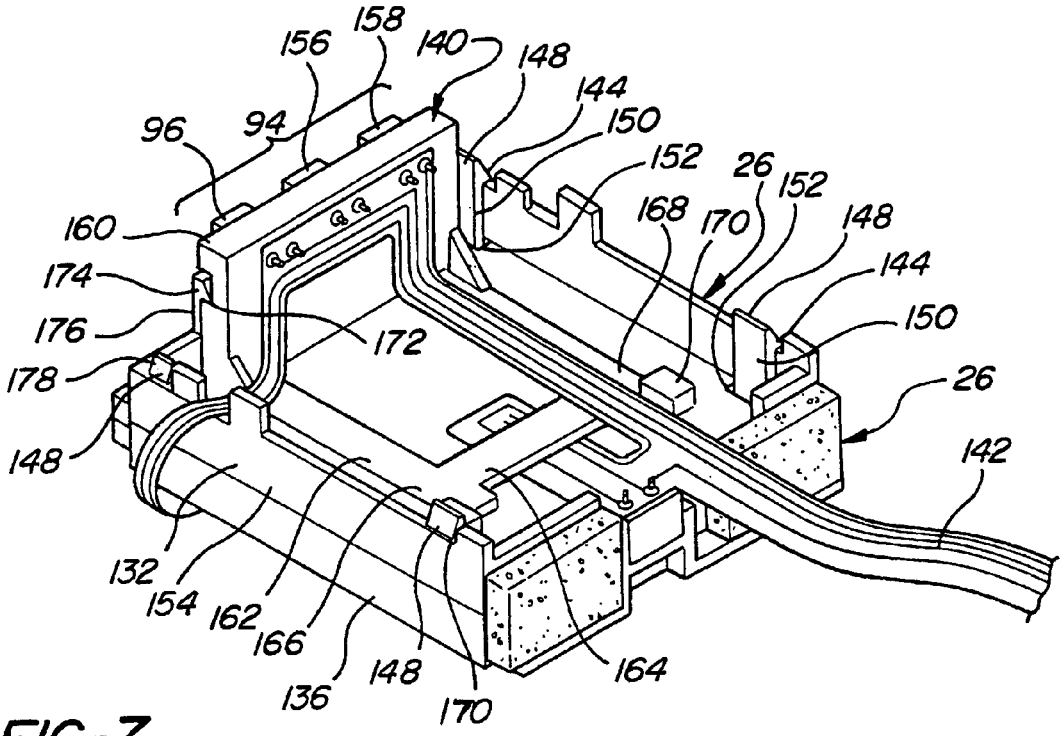
FIG. 7 is a magnified top perspective view of a key card reader portion of the electronic lock of FIG. 2.
Figure 8:
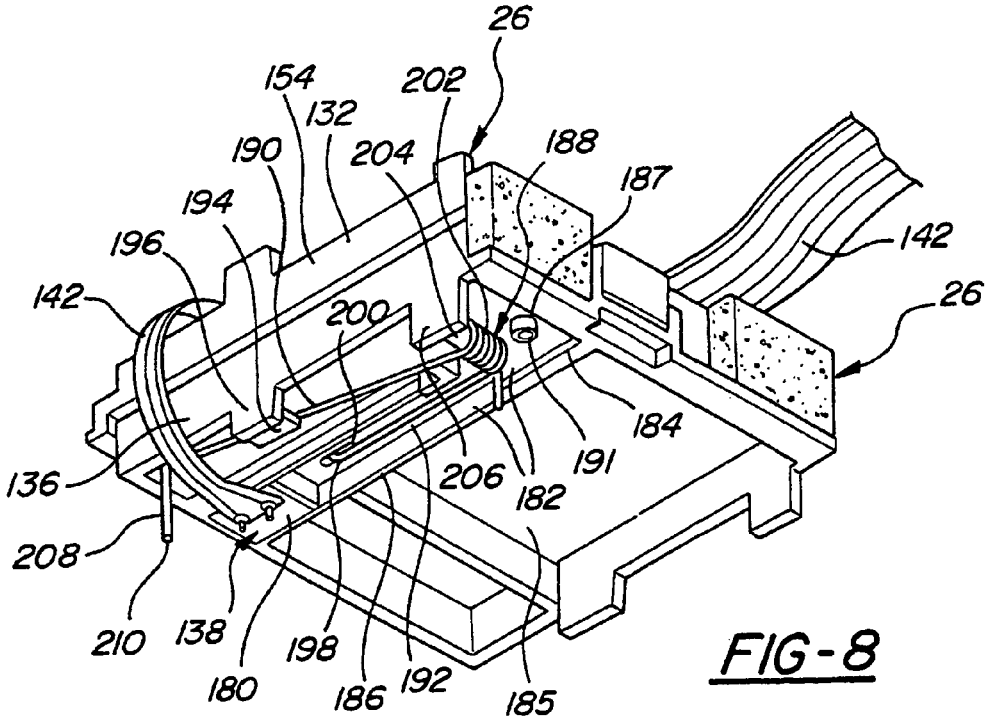
FIG. 8 is a bottom perspective view of the key card reader of FIG. 7.
Figure 9:
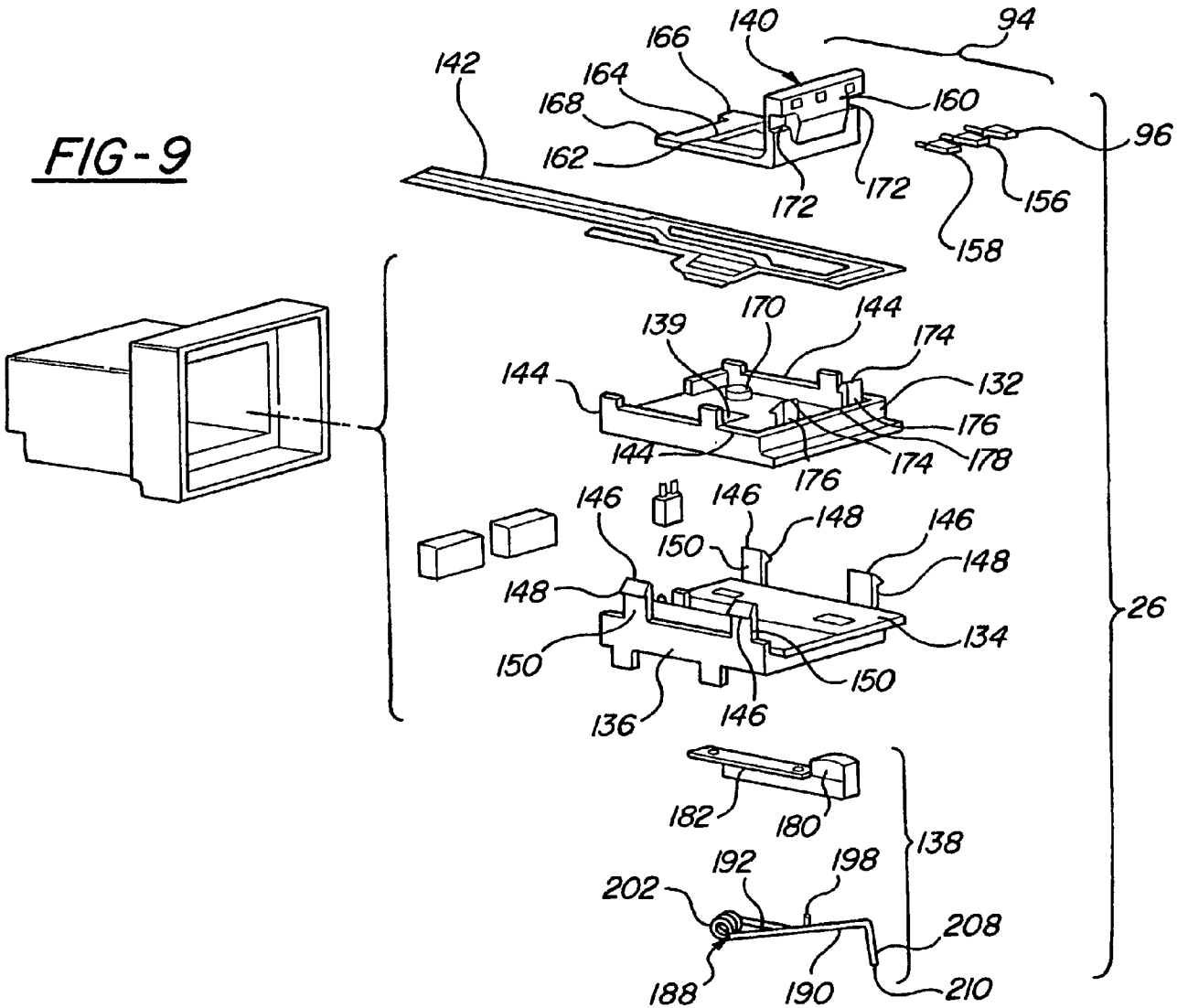
FIG. 9 is an exploded perspective view of a card reader module constructed according to the invention.

The sliding stop 34 includes a spring 80 configured and positioned to store energy when the sliding stop is either blocked or hung-up by friction as it is being moved into or out of engagement with the handle hub 16 as shown in FIG. 6. The spring 80 urges a slider portion 85 of the sliding stop 34 into the commanded position whenever such a blockage or hang-up is finally overcome or removed as shown in FIG. 5. Both the spring 80 and a portion of the slider portion 85 are disposed within a sliding stop body 88. The sliding stop body 88 includes a slider receptacle 87 that slidably retains the slider portion 85 and a spring chamber 86 that houses the spring 80.

The spring 80 is a coil type spring disposed between two facing spring engagement surfaces 82, 84 in the spring chamber 86 of the sliding stop 34. A forward one 82 of the engagement surfaces 82, 84 is disposed at one end of the spring chamber 86 on an inner cutout region of the slider portion 85 of the sliding stop 34. A rear one 84 of the engagement surfaces 82, 84 is disposed at an end of the spring chamber 86 opposite the forward engagement surface 82 on an inner wall of the sliding stop body 88. The spring 80 therefore biases the slider portion 85 toward the handle hub 16.

The sliding stop body 88 also includes a cam receptacle 90 formed into a lower surface 92 of the body 88. The bearing surface 38 of the sliding stop 34 is disposed on a circumferential inner wall of the cam receptacle 90 that has a circular shape with a diameter slightly greater than that of the outer circumferential bearing surface 40 of the rotary cam 29. The inner wall diameter is slightly larger so that the rotary cam 29 can be received into the cam receptacle 90 for relative rotational sliding engagement. The cam receptacle 90 cooperates with the rotary cam 29 to convert rotational motion of the rotary cam into translational motion of the sliding stop 34 between an engaged position shown in FIG. 5 and a disengaged position shown in FIG. 4.

The handle hub 16 is reversible in that it is configured to be axially reversed or flip-flopped in the lockset case 12. The handle hub 16 is configured to be reversible so that the mortise lockset apparatus 10 can be adapted to applications where it may be necessary or desirable to lock out an interior handle 19 rather than the exterior handle 18 as shown in the drawings, i.e., to allow an installer to select whether the lockout feature will lockout the inside or the outside door handle 18.

The electronic mortise lockset apparatus 10 also includes a retractable deadbolt 98 that is movably supported within the lockset case 12. An outer portion of the deadbolt 98 extends horizontally from the lockset case 12 when the deadbolt is in an extended position and is withdrawn within the lockset case when the deadbolt is in a retracted position. The deadbolt 98 is positioned such that the outer portion of the deadbolt engages a complimentary recess formed in the doorframe, and/or a metal plate fastened to the doorframe, when the deadbolt 98 is in the extended position and the door is in a closed position.

The lockset also includes a hand operable lever 100 that is pivotably supported on and extends generally perpendicularly from a side wall 102 of the lockset case 12 opposite the handle 18. The lever 100 is mounted on a spindle 104 that is supported transversely in the lockset case 12, the spindle having a generally continuous square cross-section along its length. The spindle 104 is operably connected to the retractable deadbolt 98, the deadbolt being retractable from the extended position by turning the lever 100. In other words, the spindle 104 is connected to the deadbolt 98 and moves whenever the deadbolt moves.

A deadbolt position indicator having a microswitch 106 mounted on the lockset motherboard 78 is also included. The spindle 104 passes through an aperture 108 in the motherboard 78 and turns a spindle-mounted cam 110 that is mounted on the spindle 104 adjacent a point along the length of the spindle 104 where the spindle 104 passes through the motherboard aperture 108. The microswitch 106 is supported on the motherboard 78 in a position where a radially protruding lobe 112 of the spindle-mounted cam 110 actuates the microswitch when the spindle 104 is turned. The spindle mounted cam 110 is rotationally oriented such that the lobe 112 mechanically depresses the microswitch 106 when the deadbolt 98 moves either into or out of its engaged position. In response to depression, the microswitch 106 transmits a deadbolt position indicating signal to logic circuitry of the lockset controller 28 indicating either that the deadbolt 98 is engaged or retracted, as will be subsequently explained. The deadbolt position indicating signal allows the lockset controller 28 to monitor deadbolt position.

The lockset apparatus 10 also includes a fire blocker feature that prevents fire from spreading through the complimentary cavity in the door. As shown in FIG. 2, the apparatus 10 includes a zinc chassis 116 that mounts against an inner side or interior surface of a door. A steel front plate 118 mounts against an outer side of the door opposite the chassis 116. A steel outer box frame 114 mounts over the steel front plate 118. Cosmetic outer and inner steel lockset covers or face plates 120, 122 are fastened over the outer box frame 114 and the zinc chassis 116, respectively. Four fastener receivers 123 extend integrally from a back surface of upper and lower flanges of the outer box frame 114 and are aligned with holes in the front plate 118 and corresponding holes formed through the width of the door. Four chassis mounting fasteners 124 are received into the respective fastener receivers 123 and pass through the chassis 116, the door and the front plate 118. The chassis mounting fasteners 124 and receivers 123 cooperate to connect and hold the chassis 116 and outer box frame 114 together. They also secure the chassis 116 and box frame 114 to the door by clamping them against the respective inner and outer door surfaces and suspending them from the fastener receivers 123. With all handles and hardware attached, the outer box frame 114 and steel front plate 118 leave no openings through the door for burning gases to pass.

The fire blocker feature includes upper and lower flat rectangular steel washer plates 126 disposed on the inner side of the door between the chassis 116 and the inner surface of the door. Each washer plate 126 includes two openings 128 for receiving respective shaft portions of two of the chassis mounting fasteners 124. These two holes align with the two holes in the chassis 116 that the chassis mounting fasteners 124 pass through. These openings are smaller in diameter than head portions of the chassis mounting fasteners 124 so that the washer plate 126 prevents the fastener heads from being pulled through the outer side of the door if fire burns or melts the chassis 116 away. Two screws 129 secure each washer plate 126 and a cosmetic end cap 131 to the chassis 116.

In the present embodiment the washer plate 126 is made of steel but may be made of any material that is relatively more fire resistant than the chassis 116 and is strong enough to support fastener heads under axial loads. The washer plates 126 help prevent fire from gaining entry to a room through the complementary cavity in the door. They do so by holding the front plate 118 and box frame 114 in place over the complementary cavity even after the chassis 116 has been burned and/or melted away.

The key card reader module 26 is a snap together unit that includes a generally rectangular molded plastic upper module component 132 including an upper wall of a key card receptacle 134 and a generally rectangular molded plastic lower module component 136 connected to the upper module component and including a lower wall of the key card receptacle 134. The key card reader module also includes a magnetic card reader assembly 138, a smart card interface unit 139, an LED display module 140 and a ribbon cable 142 that provides electrical current paths between components of the card reader module 26 and the lockset controller 28, as will be further explained.

The upper and lower module components 132, 136 each include four snap-lock detents 144, 146. The four snap-lock detents 146 of the lower module component 136 engage the four snap-lock detents 144 of the upper module component 132 when the two module components 132, 136 are pressed together. The four detents 146 of the lower module component 136 are disposed on a lower surface of barbs 148 formed at the upper ends of each of four elongated rectangular arms 150 that extend integrally upward from adjacent four corners 166, 168 of the lower module 136, respectively, and are shaped and positioned to fit through corresponding slits 152 in the upper module component 132. The four detents 144 of the upper module component 132 are disposed on a rectangular, integrally upwardly extending rectangular rim 154 of the upper module component 132. The snap lock detents 144, 146 connect the upper and lower module components 132, 136 together by snap fit engagement when the components 132, 136 are pressed together during assembly. More specifically, when the module components 132, 136 are pressed together, the barbs 148 pass through the slits 152 and snap over the rectangular rim 154, thereby preventing the module components 132, 136 from being pulled apart. The snap lock detents 144, 146 obviate the need for any additional fasteners to hold the key card reader module 26 together.

The key card reader module 26 includes dual function components that further simplify its assembly and operation. One such dual function component is the LED display module 140. The primary function of the LED display module 140 is to display lockset apparatus operation and status information to individuals operating the lockset apparatus 10. The lockset controller 28 causes the LED display module 140 to selectively illuminate the red LED 96, yellow LED 156, or green LED 158 when the lockset apparatus is locked , malfunctioning, or open, respectively. The three colored LEDs 96, 156, 158 are supported in an upwardly extending front panel 160 of the LED display module 140.

Figure 11:
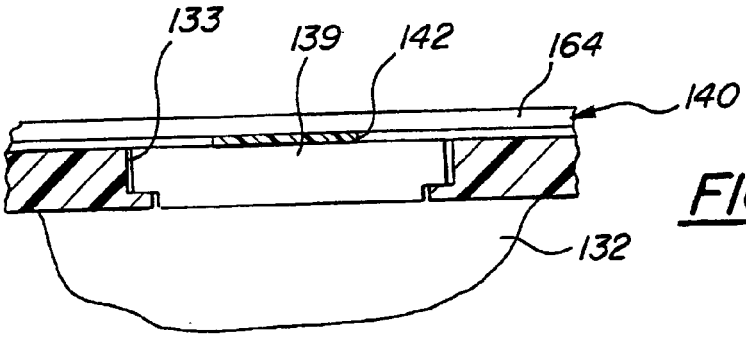
FIG. 11 is a partial cross-sectional fragmentary view of a smart card interface unit supported in an upper wall of the key card reader of FIG. 7.

In addition to displaying information, the LED display module 140 is also configured to anchor the ribbon cable 142 and the smart card interface unit 139 to the key card reader module 26. The LED display module 140 includes a generally U-shaped rectangular support frame 162 that extends horizontally from a bottom edge of the front panel 160 of the LED display module 140. The support frame 162 has an aft cross-bar 164 that clamps a portion of the ribbon cable 142 against the upper wall of the upper module component 132 of the key card reader module 26 when the LED bar is mounted on the key card reader module 26. As best shown in FIG. 11, the cross-bar 164 also retains the smart card interface unit 139 in a generally rectangular aperture 133 formed in the upper wall of the upper module component 132.

The LED display module 140 is mounted on the key card reader module 26 by first sliding opposite corners 166, 168 of the aft cross bar into a pair of complementary slots formed into a pair of rectangular protrusions 170 that integrally extend upward from the upper wall of the upper module component 132. The front panel 160 of the LED display module 140 is then pressed downward against the upper module component 132 until a pair of snap-lock detents 172 formed into a front surface of the front panel 160 engage a pair of snap-lock detents defined by respective barbs 174 formed at upper ends of respective upwardly extending elongated rectangular arms 176 that extend integrally upward from a front edge 178 of the upper module component 132 of the key card reader module 26.

Figure 12:
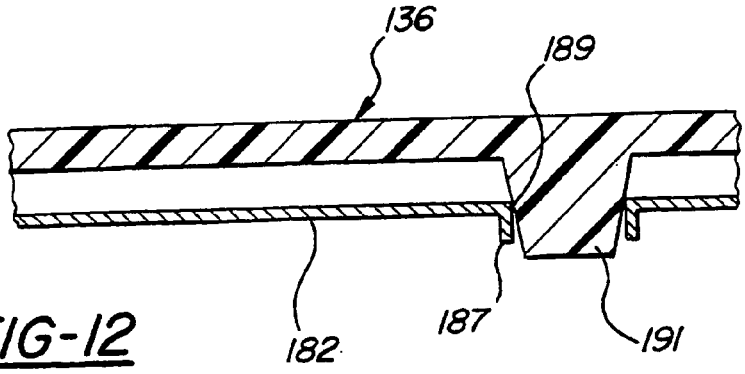
FIG. 12 is a partial cross-sectional fragmentary view of a tapered pin extending from a base wall of the key card reader of FIG. 7 and supporting a read head support arm for pivotal and gimbling movement.

The key card reader module 26 is configured to read magnetic strips affixed to magnetic key cards and to communicate with integrated circuit chips embedded on smart key cards. To read magnetic key cards the magnetic card reader assembly 138 of the key card reader module 26 includes a magnetic read head 180 configured to read magnetic strips of magnetic key cards. The read head 180 is supported at one end of a generally rectangular elongated metal read head support arm 182. The read head 180 and support arm 182 are received into a complementary-shaped trough 184 formed in a bottom surface 185 of the lower module component 136. The trough is defined by an intersection of rectangular ribs 186 that integrally extend downward from the bottom surface of the lower module component 136. The read head 180 is positioned to extend partially through a rectangular aperture (not shown) formed in the bottom surface of the lower module component 136 at a forward end of the trough. As is best shown in FIG. 12, the read head support arm 182 includes a generally cylindrical extension 187 that integrally protrudes upward from around a generally circular aperture 189 formed through an end of the support arm 182 opposite the read head 180. The aperture 189 and cylindrical extension 187 are shaped to receive and to seat part way down the length of a tapered pin 191 that integrally extends from the bottom surface of the lower module component 136 within the trough 184. The tapered pin 191, aperture 189 and cylindrical extension 187 are shaped to support the read head support arm 182 in such a way as to allow the support arm 182 and read head to gimbal, i.e., to pivot longitudinally and roll laterally. The up and down longitudinal pivoting action permitted by this arrangement allows the read head to better accommodate cards of varying thicknesses. The rolling action allows the read head to lay flat on the magnetic strip of warped cards.

Another dual function component of the key card reader module 26 is a biasing spring 188. The biasing spring 188 is a coil spring that is supported in such a way that it biases the read head 180 support arm 182 upward, i.e., pivotally upward about the tapered pin. This upward bias continuously urges the read head 180 upward through the rectangular aperture to maintain contact with the magnetic strip of magnetic key cards that are individually inserted into the key card receptacle 134. This upward biasing force also serves to hold the read head support arm 182 in place on the lower module component 136 without the need for fasteners. To accomplish this, opposite ends of a wire forming the coil spring 188 are formed into a pair of generally straight, elongated "legs" 190, 192. A first leg 190 of the pair of legs is anchored against the bottom surface of the lower module component 136 by a rectangular tab 194 that extends laterally from one of the downwardly extending ribs. A second leg 192 of the pair of legs is engaged against the arm 182 and applies spring 188 force to bias the arm 182 upwardly as described above. The second leg 192 includes a right-angle bend 198 adjacent its distal end that extends upwardly into a small aperture 200 formed in the arm 182. The coil portion 202 of the spring is seated coaxially on a post 204 that extends laterally from a rectangular tab 206. The rectangular tab 206 extends integrally downward from one of the downwardly extending ribs. An end portion 208 of the first leg 190 is bent to extend downward and outward from the lower module component. The distal end 210 of the end portion 208 is positioned to contact the outer box frame 114 to electrically ground the card reader module 26.

Figure 10:
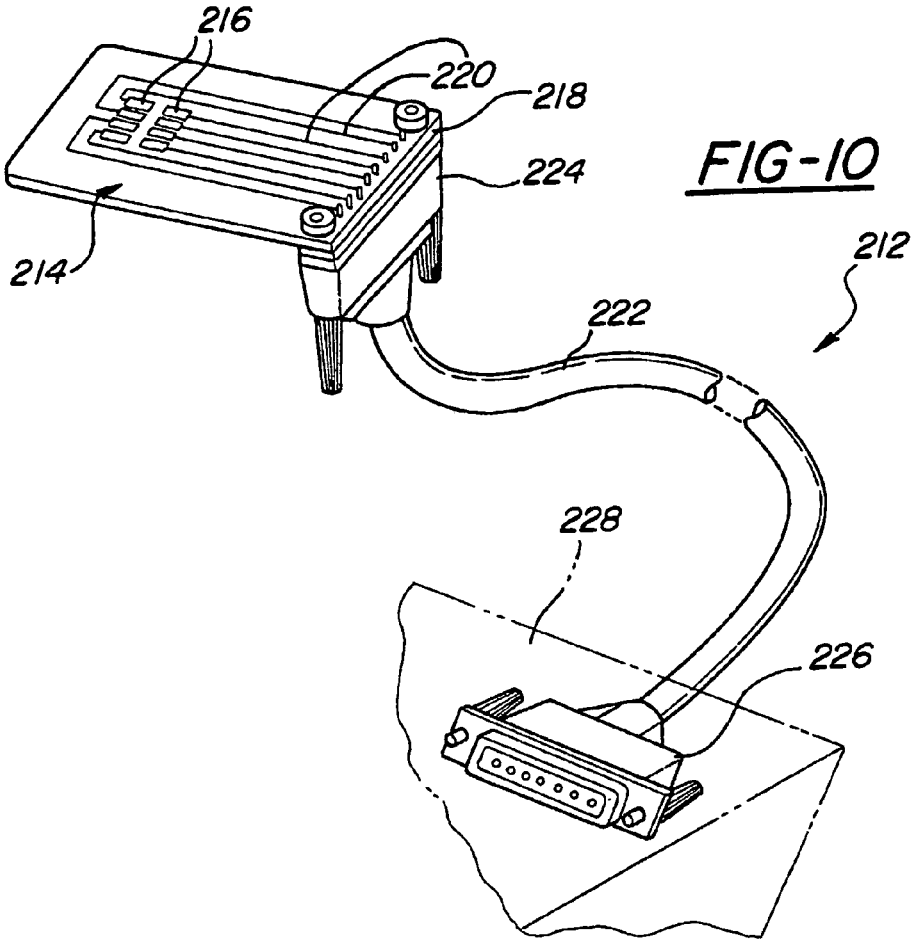
FIG. 10 is a perspective view of a lock programmer/interrogator constructed according to the invention.

The lockset apparatus 10 also includes a lockset apparatus programmer/interrogator, generally shown at 212 in FIG. 10, for communicating with an electronic lockset apparatus 10. The lockset apparatus programmer/interrogator 212 includes an interrogator key card 214 comprising a circuit card that includes surface contacts 216 positioned to align with corresponding contacts of an electronic lockset apparatus smart card reader module 26 within a reader module when the interrogator key card is inserted into the reader module. A serial port cable connector 218 is also mounted on the circuit card. The circuit card includes current paths or tracings 220 that electrically connect the surface contacts 216 to connector pins of the cable connector 218. The lockset apparatus programmer/interrogator 212 also includes a serial cable 222 that has a serial port connector 224 at one end that connects to the cable connector of the interrogator key card and a second serial port connector 226 at the other end that is configured to connect to a microcomputer 228. The serial cable 222 includes wires that connect the serial port connectors 218, 226 at each end of the cable 222 to connect the tracings 220 of the interrogator key card 214 to corresponding circuits within the microcomputer 228. The microcomputer 228 is programmed to interrogate, apply power to and/or program an electronic lockset apparatus 10 through the interrogator key card 214 once the interrogator key card 214 has been inserted into the lockset apparatus 10.

Figure 13:
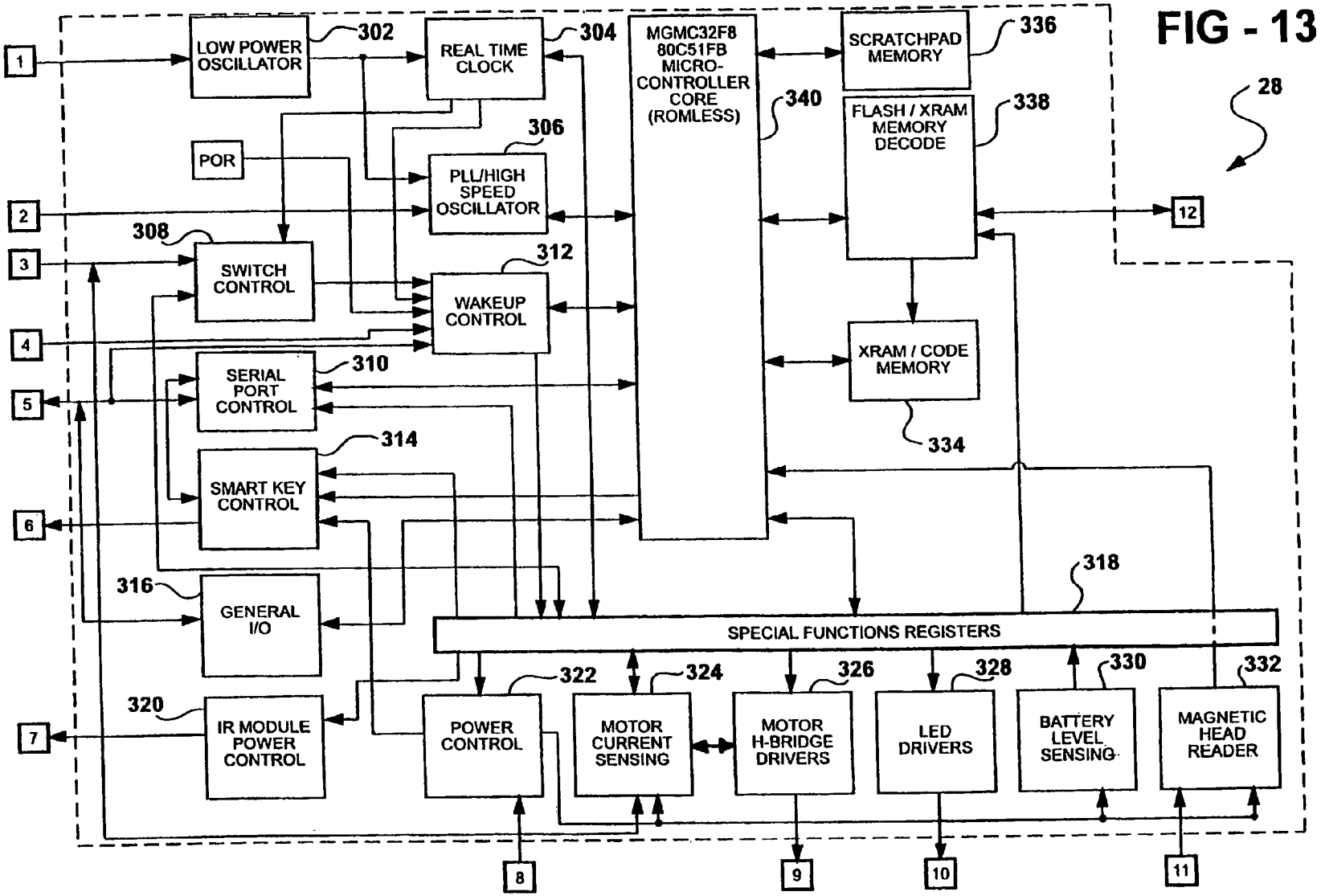
FIG. 13 is an electrical schematic view of the lockset controller 28.

Referring to FIG. 13, the lockset apparatus 10 includes a lockset controller 28 which has logic circuitry connected to numerous electronic devices, including the lockout mechanism 22 and the key card reader module 26. The lockset controller is a custom made integrated circuit having many electrical components, including a low power oscillator module 302, a real time clock module 304, a high speed oscillator module 306, a switch control module 308, a serial port control module 310, a wakeup control module 312, a smart key control module 314, a general I/O module 316, special function registers 318, an IR module power control module 320, a power control module 322, a motor current sensing module 324, a motor driver module 326, a LED driver module 328, a battery level sensing module 330, a magnetic head reader module 332, an X-ram memory module 334, a scratchpad memory module 336, a flash memory decode module 338, and a core processor 340. Generally, the lockset controller 28 operates in a low power consumption sleep mode until awakened by one of several wakeup events. At which point, the lockset controller 28 executes a series of commands that are determined by the particular event which woke the lockset controller up and certain conditions relating to the various states of components throughout the lockset controller. Upon executing these commands, the lockset controller may take control of components located outside of the controller, such as the LED display module 140, the lockout mechanism 22, or the key card reader 26.

Figures 14, 15:
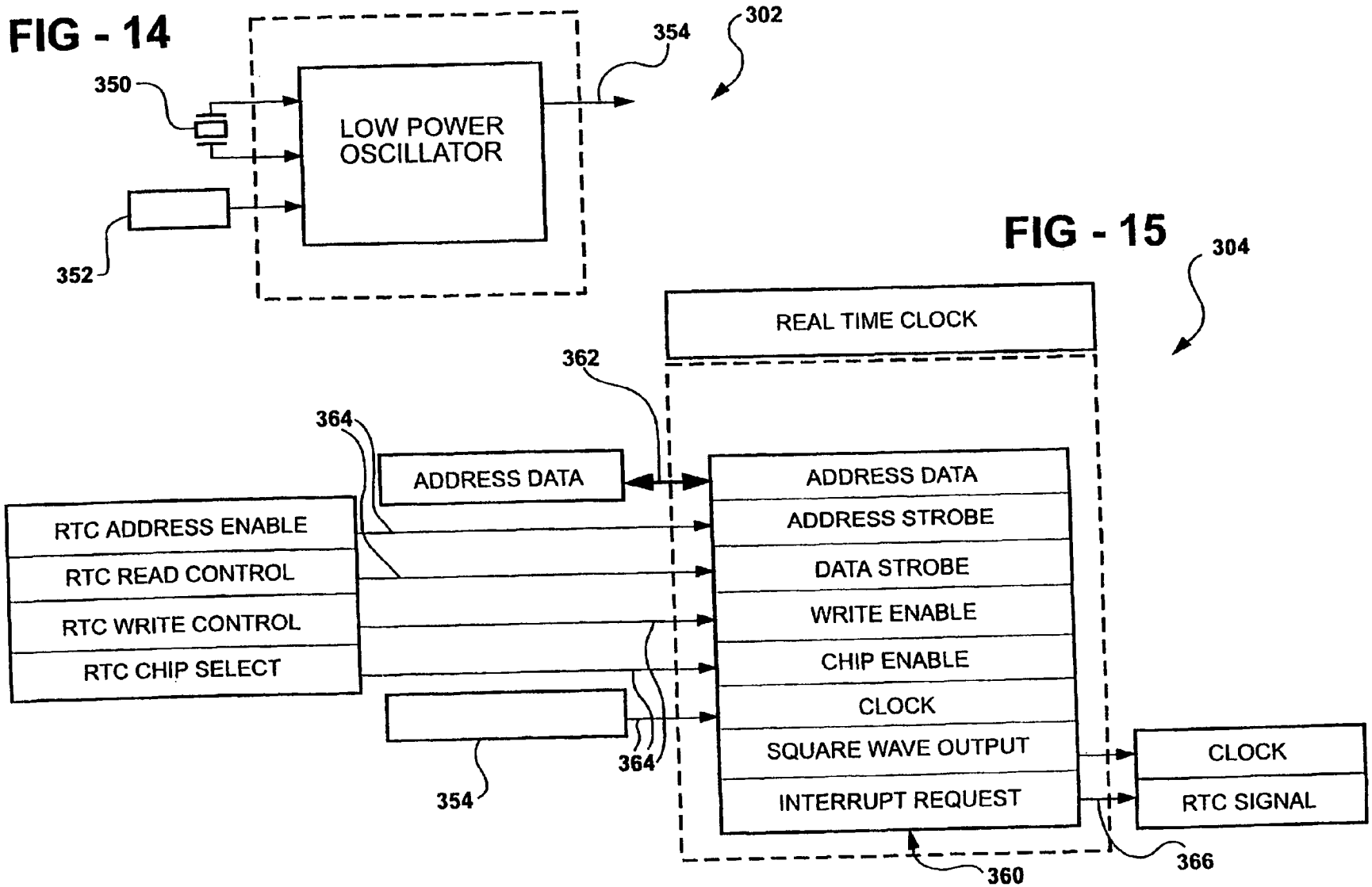
FIG. 14 is an electrical schematic view of the low power oscillator module 302.
FIG. 15 is an electrical schematic view of the real time clock module 304.

As seen in FIG. 14, low power oscillator 302 is a low frequency, low power consuming oscillator which produces a synchronous signal of approximately 32.768 kHz and is generally comprised of a crystal 350, a crystal bias 352, and an output 354. A particular voltage is applied to the crystal which causes it to vibrate at a generally consistent frequency, as is commonly known in the art. This vibrational frequency can be precisely tuned through use of the crystal bias 352, thereby allowing the crystal to produce a particular frequency. This frequency is applied to the output 354, which is connected to both the real time clock 304 and the high speed oscillator 306. It is important to note, the low power oscillator uses very little power, on the order of a couple μA, and is useful in achieving the stated goal of decreasing the overall power consumption of the lockset controller 28, particularly when the lockset controller is in the sleep mode, as will be subsequently explained.

The real time clock 304 is electrically connected to the low power oscillator 302, the wakeup control 312, the special function registers 318, and the switch control 308, and basically functions as a counter which issues wakeup signals to the wakeup control 312, as seen in FIG. 15. The real time clock 304 is generally comprised of several registers 360, an address/data bus 362, additional inputs 364, and an output 366. The registers store a variety of information, such as a running count of the number of times the 32.8 kHz signal is received on one of the additional inputs 364 and the predetermined number of signal inputs the real time clock will receive before issuing a wakeup request. It is important to note, the registers 360 are software programmable such that the frequency with which output 366 issues wakeup request signals is programmable. This feature allows the operator to determine how frequently the real time clock issues an interrupt which wakes the lockset controller out of sleep mode. When the real time clock is receiving information, the address/data bus is used to determine the address of the selected real time clock register 360. However, the same bus may also be used to transmit data found in a selected register, as determined by the state of a write enable pin, also an additional input 364. The real time clock 304 is a counter based on the signal generated by the low power oscillator 302 and therefore is not concerned with any actual time. The real time clock 304 is reset when the batteries are changed, the lockset controller 28 is programmed, or when certain other events occur such as power on reset.

Figure 16:
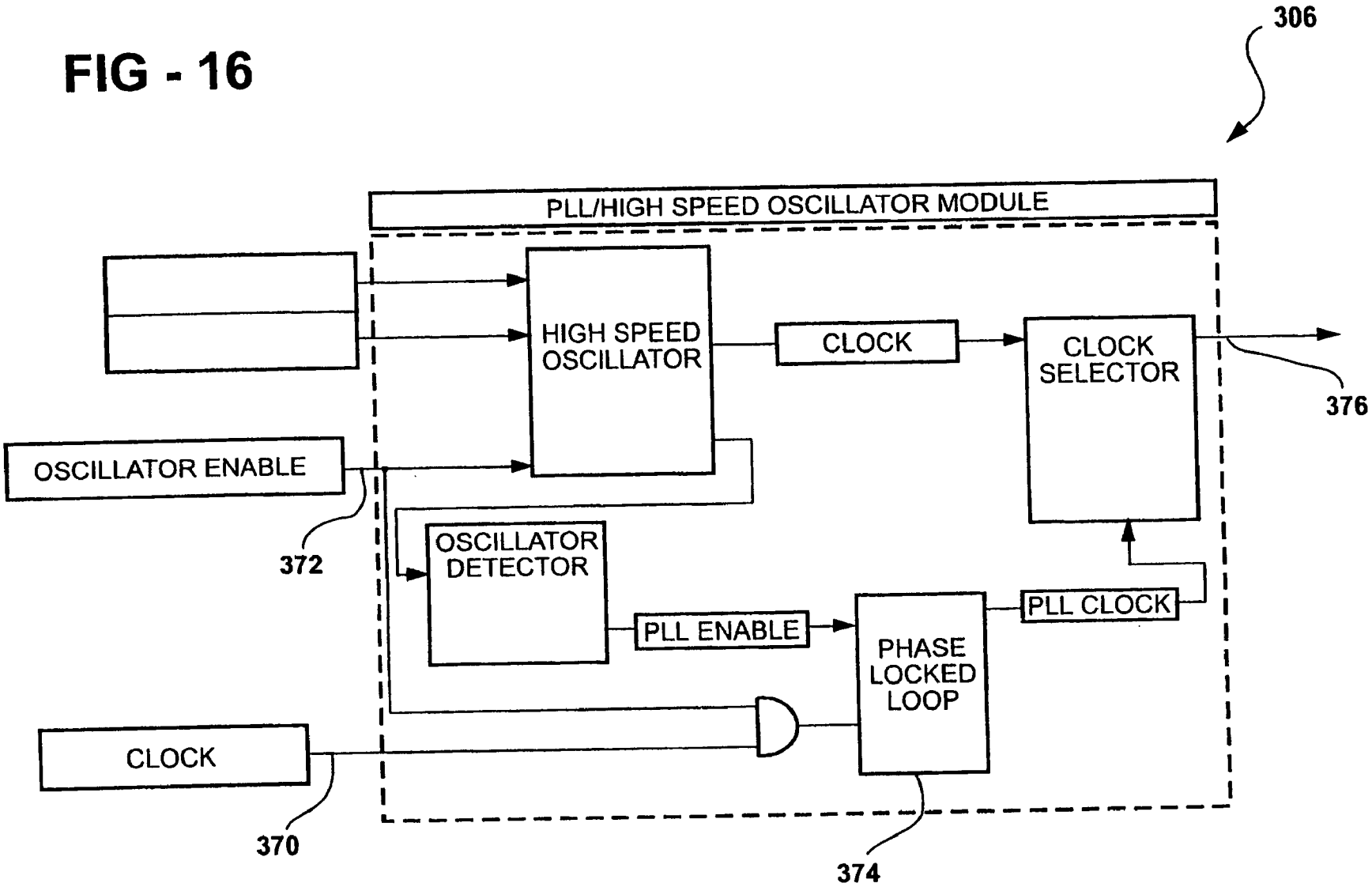
FIG. 16 is an electrical schematic view of the high speed oscillator module 306.

When the lockset controller 28 is not in sleep mode, the high speed oscillator 306 receives a slow signal from the low power oscillator, multiplies that signal, and provides the core processor with a high speed clock signal, as seen in FIG. 16. The high speed oscillator is generally a non-programmable, signal multiplier and is generally comprised of a clock input 370, an oscillator enable input 372, a signal multiplier 374, and a high speed clock output 376. The signal multiplier receives the low frequency clock input 370 and, if enabled by the oscillator enable signal, multiplies that signal by some fixed number to produce a high speed clock signal which is fed to the core processor 340. If the oscillator enable signal is low, which is indicative of the sleep mode, the multiplier will neither multiply nor pass the original signal to the core processor and thereby acts as an AND gate which disables the core processor by denying it a clock signal. If the oscillator enable signal is high and the low frequency signal is multiplied by some factor, 224 in the preferred embodiment, the newly obtained high frequency clock signal is put on the high speed clock output 376 and drives the core processor.

Figure 17:
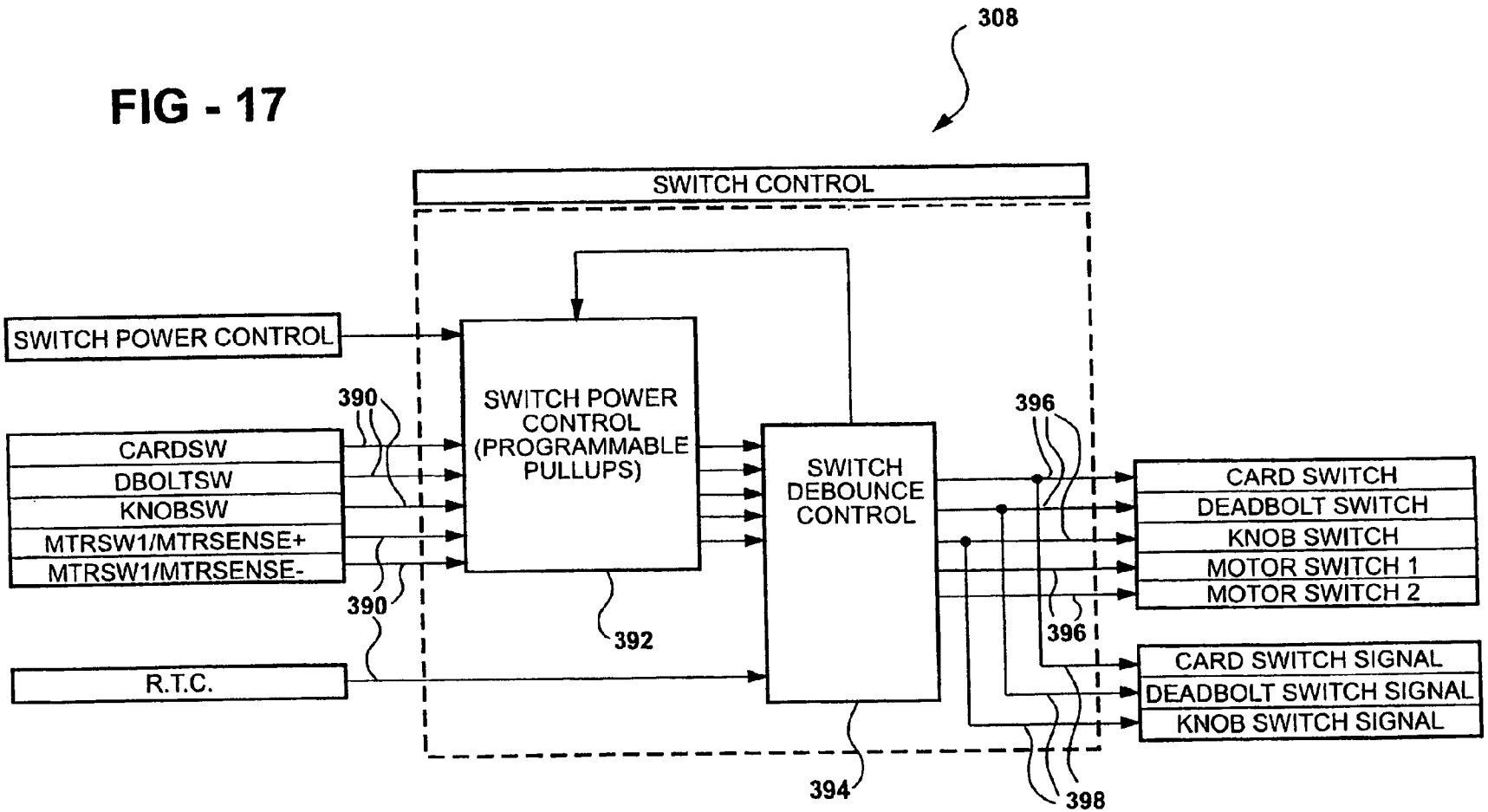
FIG. 17 is an electrical schematic view of the switch control module 308.

As seen in FIG. 17, the switch control module 308 is connected to the wakeup control 312, the real time clock 304, various electromechanical switches, and the special function registers 318 and generally includes inputs 390, switch power control 392, switch debounce control 394, status register outputs 396, and wakeup control outputs 398. The switch control 308 receives signals from various sources, such as microswitch 106, and debounces these signals such that spikes and anomalies in the signals are not mistakenly interpreted as positive signals and accidentally wakeup the lockset controller 28. The inputs 390 are each connected to a separate mechanical switch which may act as a separate wakeup source. Each of these inputs is connected to the switch power control 392 which acts as a power pull up and therefore reduces power consumption by switching the state of the signal as opposed to maintaining the signal in a constant power consuming state. The switch control module 308 periodically checks the status of the switch states, approximately 8 times per second in the preferred embodiment. The switch power control 392 is connected to the switch debounce control 394 which acts as a protective measure to prevent noise and other signal anomalies from triggering an erroneous output to wakeup control 312. When a change of state occurs at the switch power control, the switch debounce control pauses a certain amount of time and then rechecks the state of the signal to make sure that the change was not due to some temporary condition. It is important to note, the amount of time paused during the debounce is programmable and may therefore be adjusted for different types of switches, some of which may be less reliable than others and therefore require more time to confirm a change of state. Once the wakeup event signal has been confirmed, signals are sent via the outputs 396 to the special function registers 318 to update the change in status and signals are sent via outputs 398 to the wakeup control 312.

Figure 18:
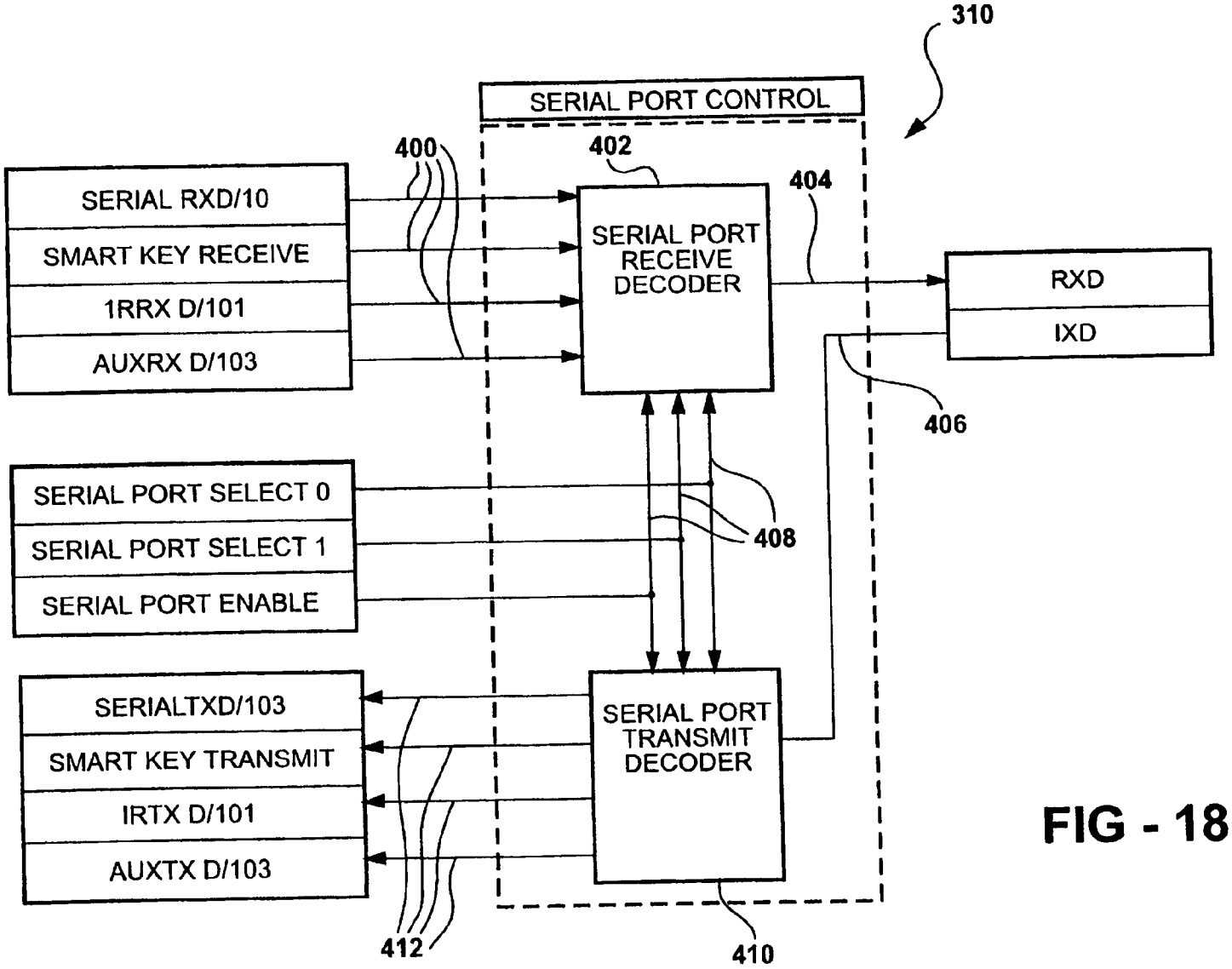
FIG. 18 is an electrical schematic view of the serial port module 310.

The serial port module 310 is a multiplexed device which allows the core processor 340 to communicate with a multitude of serial devices via a single transmit and a single receive serial line, as seen in FIG. 18. The serial port 310 is connected to several devices, such as the smart key control 314, the core processor 340, the special function registers 318, the wakeup control 312, and an external serial port, and is generally comprised of receive inputs 400, multiplexer 402, receive line 404, transmit line 406, control lines 408, demultiplexer 410, and transmit outputs 412. The receive inputs 400 each connect a serial device to the multiplexer 402 such that they may communicate one at a time with the core processor 340. These devices include an external serial port, which may be used by devices such as the lockset programmer/interrogator 212, a smart key control, an external IR receiving device, and an auxiliary device, each of which is vying for time to use receive line 404 and gain the attention of the core processor. Once the receive line 404 is active, indicating a serial device is trying to communicate with the core processor 340, the processor begins to execute a series of commands from an external program, as will be explained later. These commands are not received over receive line 404, however, the results of executing these commands may be carried out over the transmit line 406. To determine where the serial activity originated, the core processor interrogates each serial device one at a time and then begins to communicate with the active device via demultiplexer 410. The control lines 408 act as a serial port enable and determine if the multiplexer 402 or demultiplexer 410 is active. It should be noted, that while not shown in the drawing, the smart key device is able to both transmit and receive over the same serial line.

Figure 19:
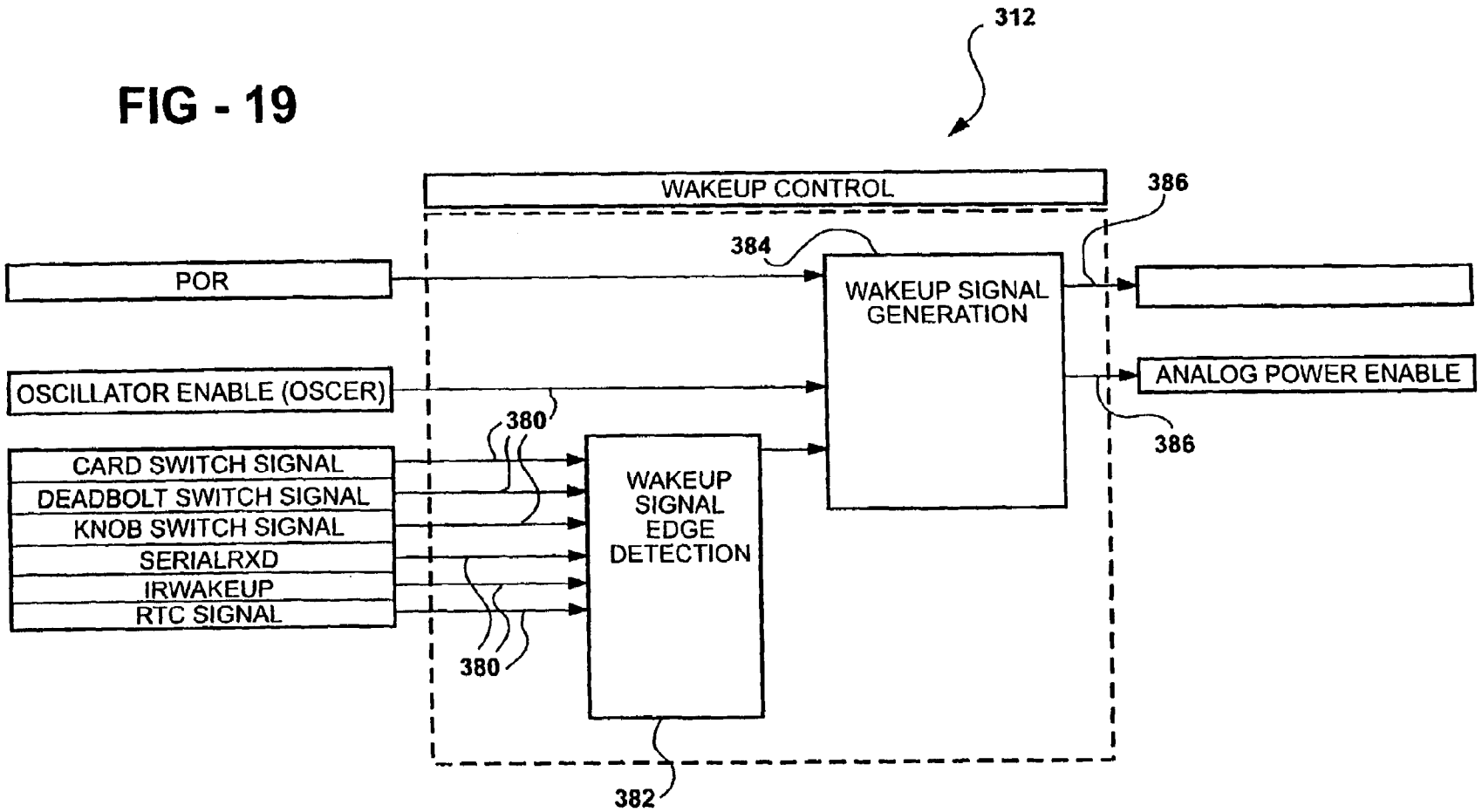
FIG. 19 is an electrical schematic view of the wakeup control module 312.

As seen in FIG. 19, the wakeup control module 312 receives signals from various sources and wakes the lockset controller 28 out of the sleep mode accordingly. The wakeup control 312 is generally comprised of a series of inputs 380, an edge detection component 382, a wakeup signal generator 384, and several outputs 386. Inputs 380 carry signals generated from several sources, including the real time clock 304, the switch control 308, an external IR port, an external serial port, and the power on reset, all of which transmit a signal to the wakeup control indicating that some event has occurred. For example, when the real time clock 304 transmits a wakeup request signal on its output 366, that signal is received by the wakeup control which proceeds to wake up the lockset controller 28. Likewise, signals transmitted by the various switches, such as microswitch 106, etc., indicating an event such as the insertion of a smart key card or the movement of the deadbolt 98 also cause the wakeup control to awake the lockset controller 28. It is important to note, the wakeup control 312 is operable by multiple wakeup sources, any one of which can wake the core processor 340 out of the sleep mode. Inputs 380 pass through the edge detection component 382, which detects a change of state by looking for either rising or falling edges. If a change of state is detected, the edge detection component 382 passes the signal to the wakeup signal generator 384. The wakeup signal generator also receives an oscillator enable signal, which prevents the wakeup control from waking up, and consequently resetting, the lockset controller 28 if the controller is already awake. Lastly, outputs 386 are connected to the core processor 340 and supply an analog power enable and reset signal, which in effect, acts like chip enable and register reset signals, respectively.

Figure 20:
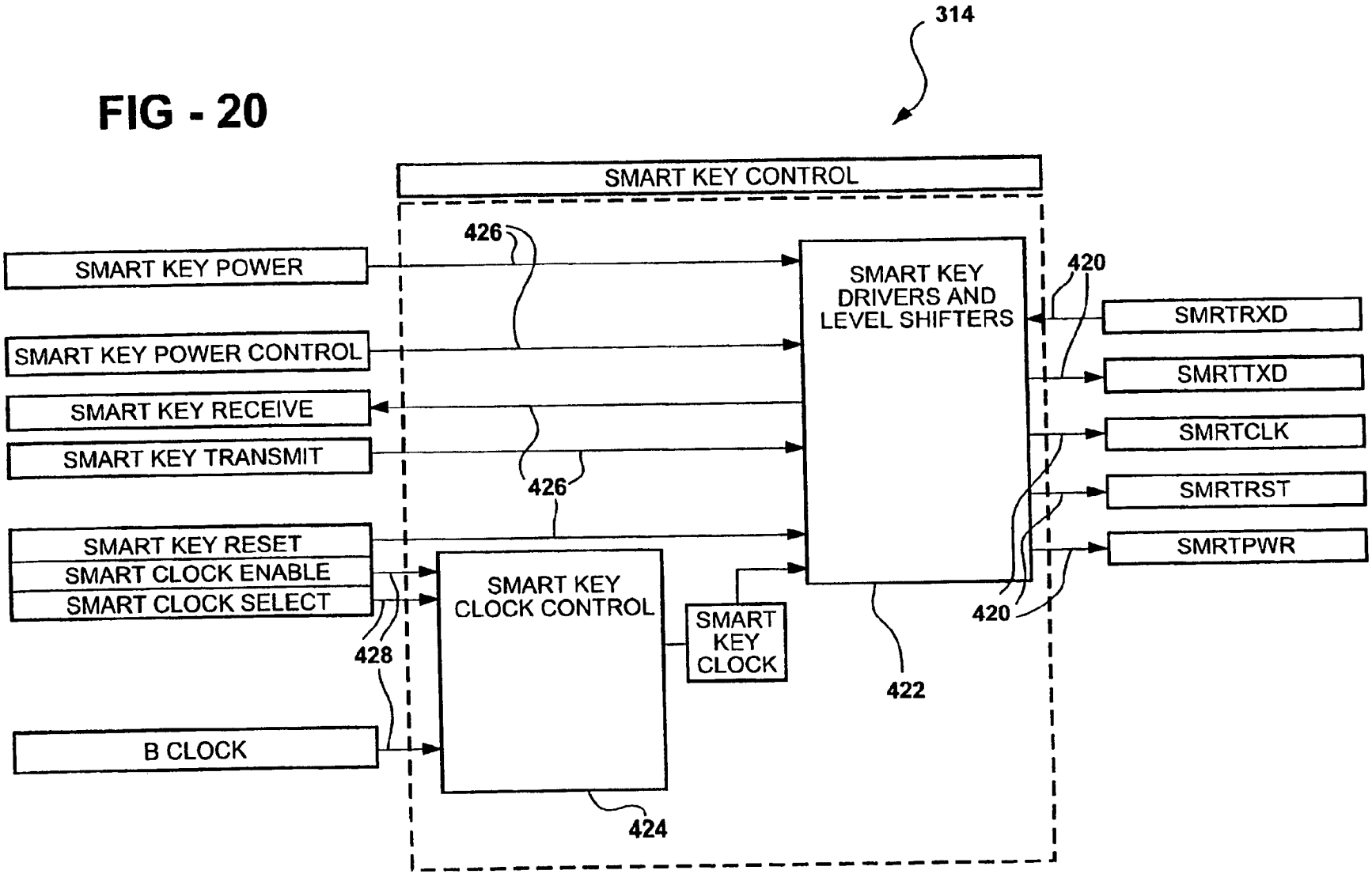
FIG. 20 is an electrical schematic view of the smart key control module 314.

The smart key control 314 is the interface which allows a standard ISO smart key card to communicate with the lockset controller 28 and is connected to the key card reader 26, the serial port control 310, the power control 322, the special function registers 318, and the core processor 340, as seen in FIG. 20. The smart key control generally includes smart card lines 420, level shifter 422, smart key clock control 424, level shifter lines 426, and clock inputs 428. A smart key card has a processor, instructions stored on ROM, and memory, however, it does not have any type of energy storage device or clock signal generator. Therefore, in order for the processor on the smart key card to operate, the smart key control 314 must supply the smart key card with power and a clock signal. Smart card lines 420 supply the smart key card with a power signal, a clock signal, a smart card reset, and provide transmit and receive lines for serial communication between the smart key card and the smart key control 314. Once the smart key card is inserted into the key card reader 26 and supplied the necessary operating signals, the processor on the card begins executing instructions which are contained in the smart key card ROM. Information written to the memory of the smart key card is transmitted via the smart card transmit line and information which is retrieved from the card memory is transmitted via the smart card receive line. Level shifter 422 is used as an interface between the signals of the smart key card and those used throughout the rest of the lockset controller 28. Often times, smart key cards require a different operating voltage than the rest of the lockset controller circuitry, and therefore require the level shifter to supply a particular voltage to the smart key card. Additionally, in order to conform the voltage levels of the smart key card signals to those of the lockset controller 28, the level shifter applies an appropriate DC voltage to the smart key card signals, thereby shifting the signal up or down as needed. Similar to the need for various operating voltages, the smart key control 314 must be able to provide different clock signals, as all smart key cards do not operate at the same frequency. The task of providing various frequency clock signals is handled by the smart key clock control 424. It is important to note, the smart key clock control is software programmable such that when enabled, it may selectively provide a clock signal based on a clock select input, consequently the smart key control is able to communicate with smart key cards having a wide range of operating parameters. One of the clock inputs 428 is the clock select signal which determines the frequency of the clock signal sent to the smart key card. The remaining clock inputs consist of a clock enable signal and a 'B' clock, which is a periodic signal provided by the core processor 340. Level shifter lines 426 include a smart card power supply, a smart card power control, a smart card reset, and serial transmit and receive lines. The smart card power supply is received from the power control 322, while the smart card power control is received from the special function register 318. The serial transmit and receive lines are connected to the serial port 310, and therefore communicate with the core processor 340 through the serial port as previously described.

Figure 21:
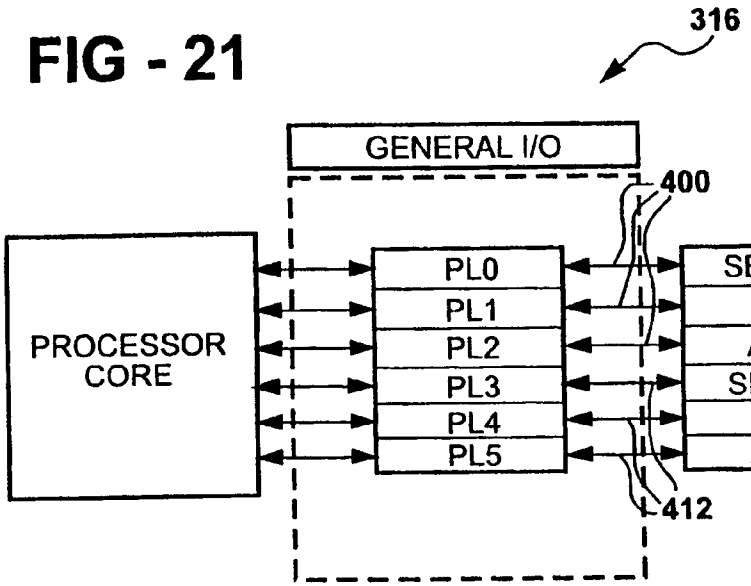
FIG. 21 is an electrical schematic view of the general I/O module 316.

As seen in FIG. 21, the general I/O module 316 is connected to the receive inputs 400 and transmit outputs 412 of the serial port control 310 and the core processor 340. The general I/O 316 is an input/output device which allows the core processor to use special communication lines, for example the IR transmit and receive lines, as general I/O.

Figure 22:
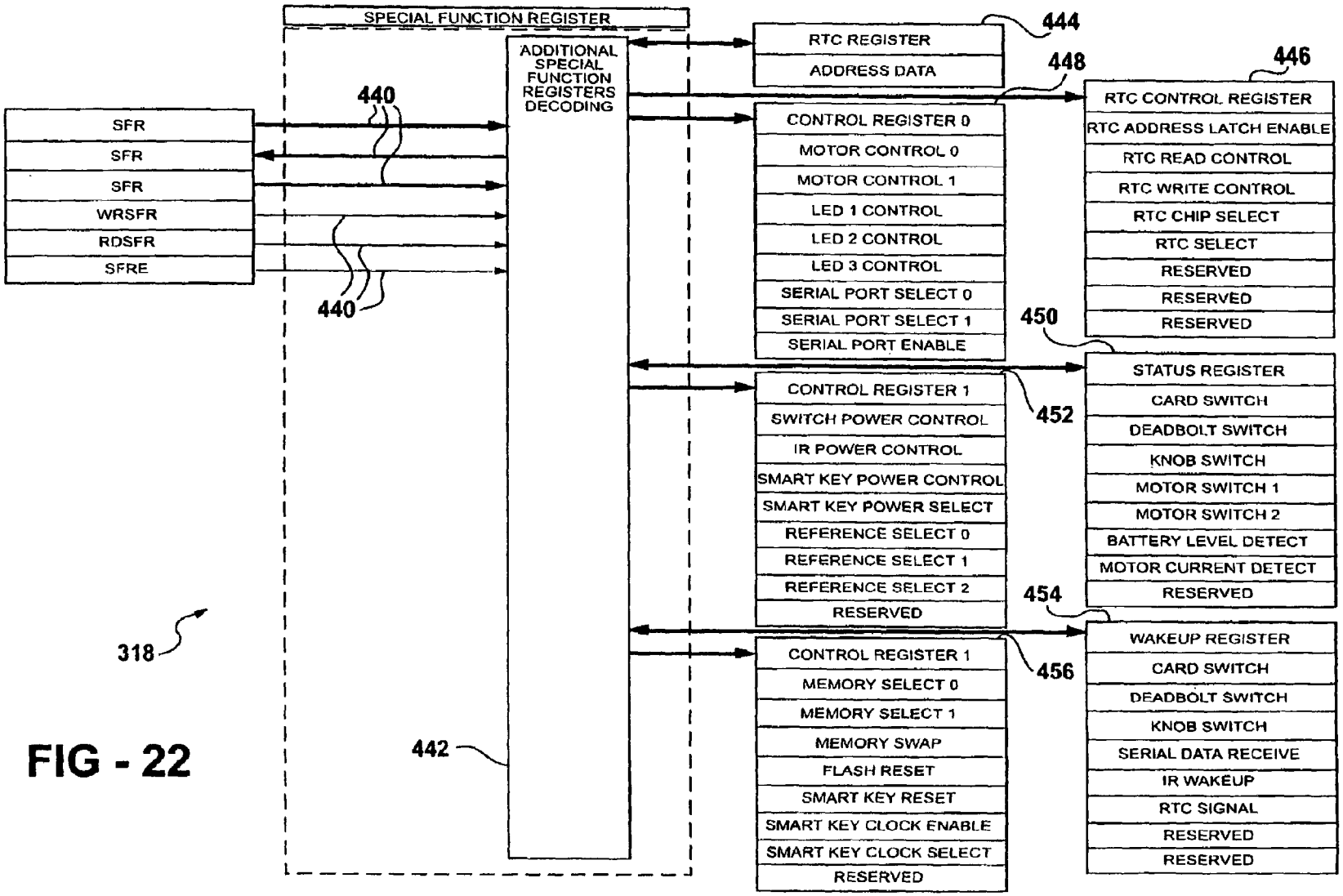
FIG. 22 is an electrical schematic view of the special function registers module 318.

The special function registers 318 are a collection of registers which store control and status data for virtually all of the components of the lockset controller 28, as seen in FIG. 22. The core processor 340 both writes to and reads from the special function registers 318, which generally comprises core input and output lines 440, register decoding module 442, and registers 444–456. The core input and output lines are comprised of several buses and control lines. There are three 8-bit buses which connect registers of the core processor 340 to the special function registers 318, such that the processor is able to place an address on a bus and retrieve the contents of that address. In addition, the core processor sends write enable, read enable, and register enable signals to the special function registers 318 which allows the processor to write new contents to the special function registers, read contents from the special function registers, and enable the registers in general, respectively. The register decoding module 442 is used to decode requests from the core processor 340 and put data gathered from the special function registers onto one of the core lines 440, as previously mentioned. Register 444 is used in conjunction with register 446 and together are connected to the register decoding module 442 by a bi-directional and uni-directional 8-bit bus, respectively. Register 444 stores the address of the particular real time clock register which is to be accessed, while register 446 is used to store control data relating to the real time clock 304. Registers 448, 452, and 456 are control registers each connected to the register decoding module 442 by a uni-directional 8-bit bus that only allows these registers to receive information. The first control register 448 includes information pertaining to the motor drivers 326, the LED drivers 328, and the serial port control 310. The second control register 452 is concerned with the operation of the switch control 308, the IR power control 320, and the smart key control 314. The third control register 456 is related to the flash memory decode 338, the flash memory, and the smart key control 314. Registers 450 and 454 are status registers, each of which is connected to the register decoding module 442 via a bi-directional 8-bit bus. Status register 450 both writes to and receives information from the core processor 340, and includes information on the current status of the smart card switch, the deadbolt switch (microswitch 106), the motor switches, the battery level sensing module 330, and the motor current sensing module 324. Like register 450, wakeup register 454 also contains information relating to the status of various components and is periodically updated to reflect any changes in that status. Wakeup register 454 includes information on the smart card switch, the deadbolt switch, the handle switch, any serial data received, IR wakeup signals, and the real time clock wakeup request signals.

Figure 23:
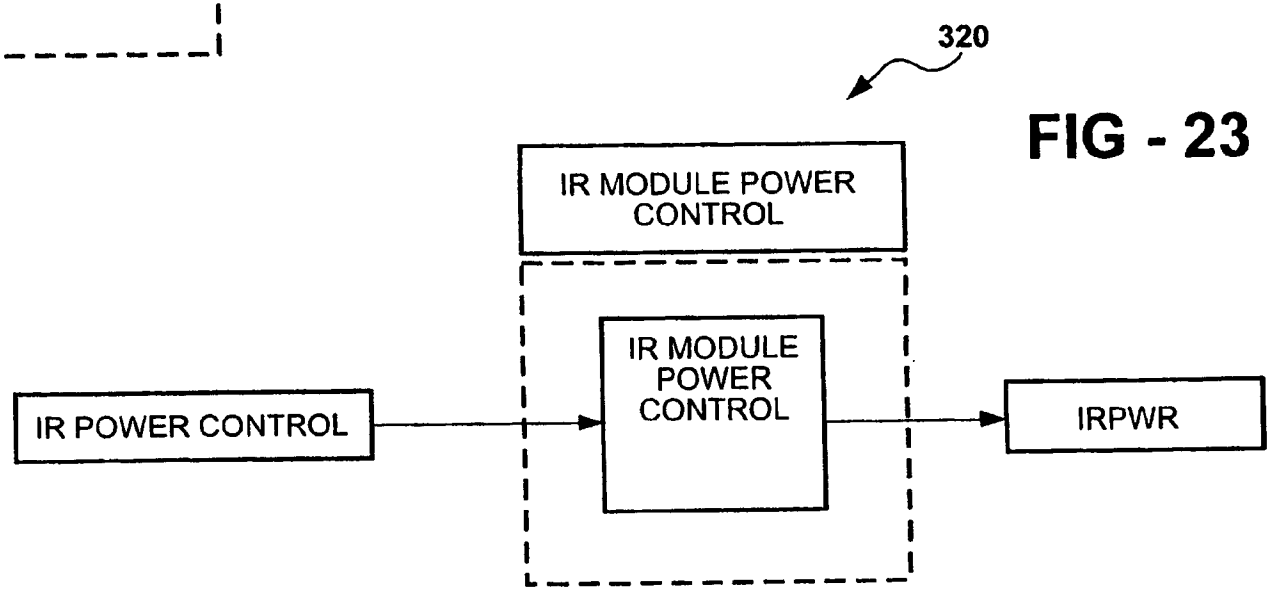
FIG. 23 is an electrical schematic view of the IR power control module 320.

As seen in FIG. 23, the IR power control 320 is connected to the special function registers 318 and an external IR communication device. When the lockset controller 28 is in sleep mode, the electrical power supplied by the IR power control 320 is very low, thereby reducing energy consumption. When the lockset controller 28 is woken from sleep mode, sufficient energy becomes available such that the IR power control 320 enables the external IR communication device to communicate with other external devices.

Figure 24:
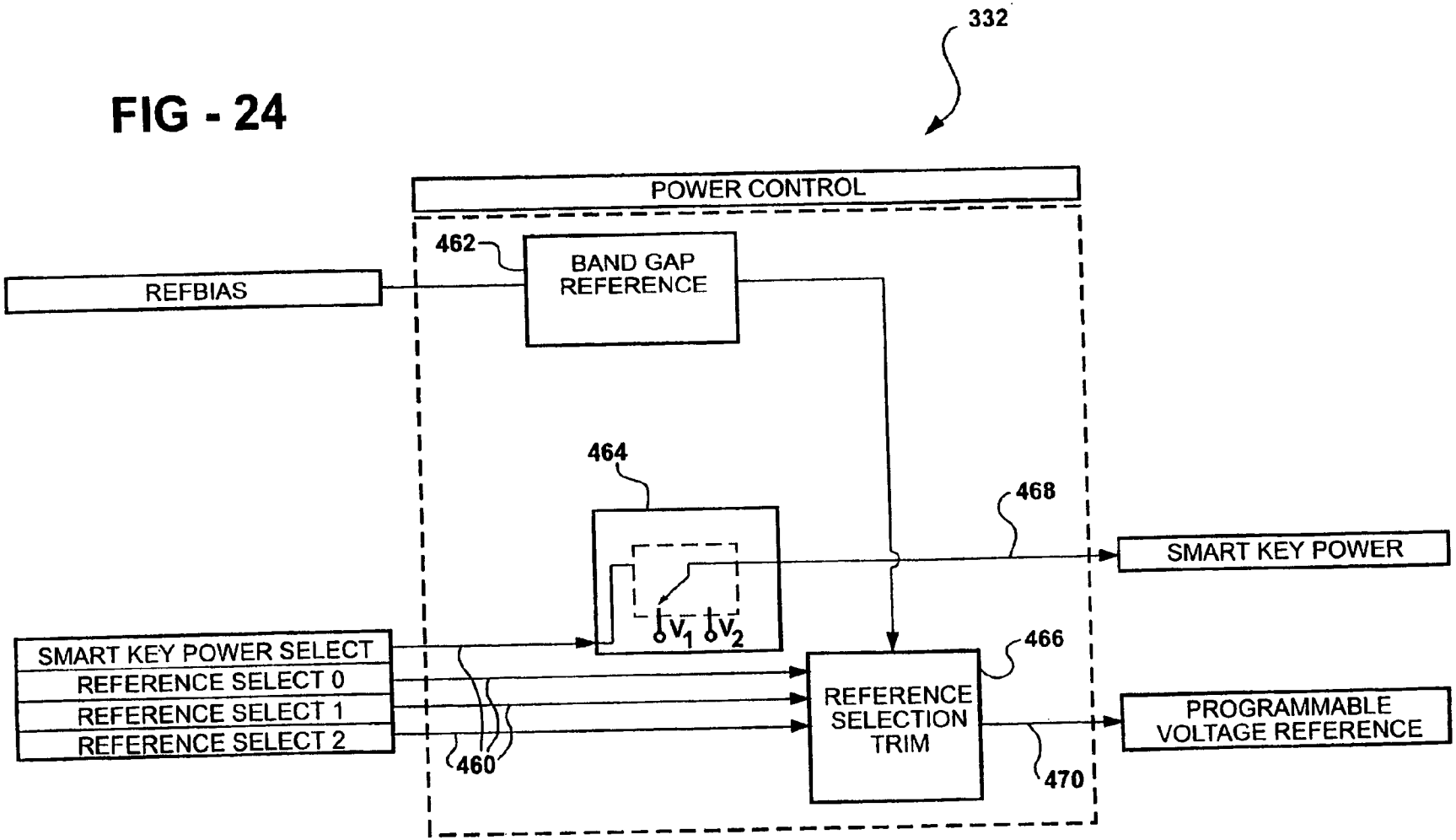
FIG. 24 is an electrical schematic view of the power control module 322.

The power control 322 is a regulated voltage source which produces an accurate reference voltage signal for use throughout the lockset controller 28. As seen in FIG. 24, the power control 322 is connected to the special function registers 318, an external voltage reference source, the smart key control 314, and several other components of the lockset controller 28. The power control 322 generally includes inputs 460, band gap voltage reference 462, power selector 464, reference selection trim 466, smart key control power output 468, and programmable reference voltage output 470. The band gap reference 462 produces an accurate 1 V signal which is sent to the reference selection trim 466 and limits the amount of input current such that the power consumption is maintained at a low level. The reference selection trim receives a 3-bit reference select signal from the second control register 452 via inputs 460. This reference select signal allows for software controlled tweaking of the reference signal such that it more accurately approaches 1.000 V. The resultant reference signal is sent to components throughout the lockset controller 28, including motor current sensing module 324, battery level sensing module 330, and the magnetic head reader module 332. Power selector 464 receives a smart key power selector signal which instructs the power selector to connect the output 468 to an appropriate voltage. As previously mentioned, various smart key cards operate at different voltage levels and thereby require card readers to have the ability to provide both voltages. The power selector 464 satisfies this requirement.

Figure 25:
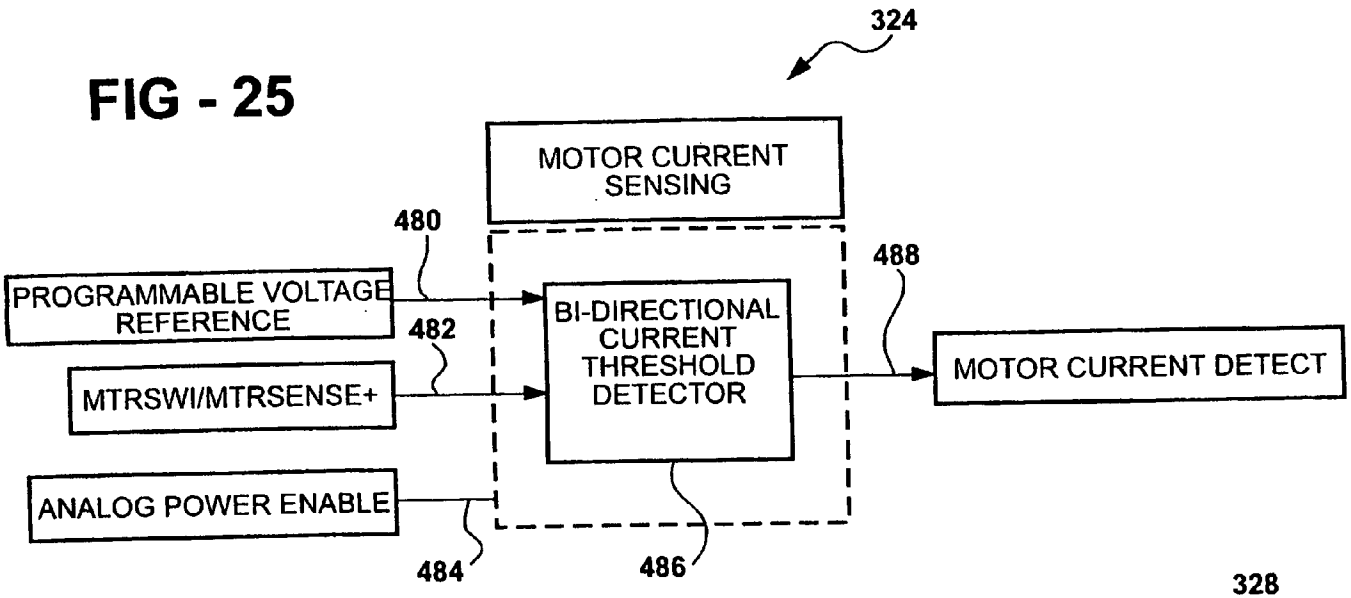
FIG. 25 is an electrical schematic view of the motor current sensing module 324.

As seen in FIG. 25, the motor current sensing module 324 is a current threshold detector which is used to sense if the amount of electric current being sent from the motor drivers 326 to the electric motor 30 has exceeded a certain value. It is important to note, the motor current sensing module 324 can determine when a motor driven component of the door handle lockout mechanism 22 reaches an end position by a change in voltage due to the amount of current being sent to the electric motor 30, thereby eliminating the need for component position determining mechanical switches. The motor current sensing module 324 is connected to the special function registers 318, the switch control 308, the power control 322, and the motor drivers 326, and generally comprises a reference voltage input 480, a motor input 482, an analog power enable 484, a current detector 486, and a motor current output 488. The analog power enable is generated when the wake up control recognizes some wake up event and empowers the motor current sensing module accordingly. The reference voltage input 480 gives the motor current sensing module a precise, known voltage, as previously explained, against which it may compare a voltage indicative of the motor current. Motor input 482 is a voltage signal representative of the amount of electrical-current being sent to the motor, as will be subsequently explained. The current detector 486 generally includes a divider and an analog comparitor and utilizes the reference voltage and the motor input to determine when a component of the lockout mechanism 32, driven by electric motor 30, has reached a limiting point and is obstructed from traveling further. The divider within the current detector 486 divides the motor input signal by a certain multiple and feeds the divided signal to an analog comparitor. The analog comparitor, often utilizing operational amplifiers, receives both the divided voltage signal and the reference signal and produces an output based on which signal is higher. Setting the division multiple to a certain value allows the current sensing module 324 to determine when the motor input 482, and hence the motor current, has exceeded a certain level, thereby indicating a point at which the lock can travel no further. The output of the current detector's comparison is put on motor current output 488 and sent to status register 450 of the special function registers 318.

Motor driver 326 is an H-bridge motor driver which drives the electrical motor 30 connected to the door handle lockout mechanism 22 via a pair of current sinks and sources, thereby allowing a nearly constant supply of electrical current and hence torque output regardless of the battery power level. The motor driver 326 is connected to the special function registers 318, motor current sensing 324, and the electrical motor 30, and generally includes motor control inputs 500, H-bridge decoder 502, current sink drivers 504, current source drivers 506, and terminals 508–514. A 2-bit motor control signal is sent from the first control register 448 to the H-bridge decoder 502 via control inputs 500. The 2-bit control signal is capable of choosing one of three acceptable operating states, which include having all of the terminals 508–514 off, only terminals 508 and 512 on, or only terminals 510 and 514 on. The H-bridge decoder receives and decodes the control signal and turns on the appropriate current sink and source drivers 504 and 506 accordingly. Terminals 508, 512 and 510, 514 operate in pairs, so as to draw current across electric motor 30. If the H-bridge decoder 502 receives a control signal which represents the state where all of the terminals are closed, then there is no current through electric motor 30 and the motor remains off. Where the H-bridge decoder receives a signal turning on terminals 508 and 512, a conductive path is formed through battery 518, terminal 508, motor 30, terminal 512, resistor 520, and ground. Such a conductive path operates the motor in a certain direction. Similarly, when the H-bridge decoder receives a signal which turns on the other pair of terminals 510 and 514, a different conductive path is created through battery 518, terminal 510, electric motor 30, terminal 514, resistor 520, and ground, which operates the motor in the opposite direction. Accordingly, the control signal sent from the first control register of the special function registers determines which direction, if at all, the motor is operated. It is important to note, that the use of current sinks and sources allows the motor driver 326 to deliver a constant current to the motor 30 and therefore obtain a nearly constant torque output curve. The current sent to the motor affects the voltage across resistor 520, which is monitored by output 482 of the motor current sensing module 324, as previously explained.

Figure 27:
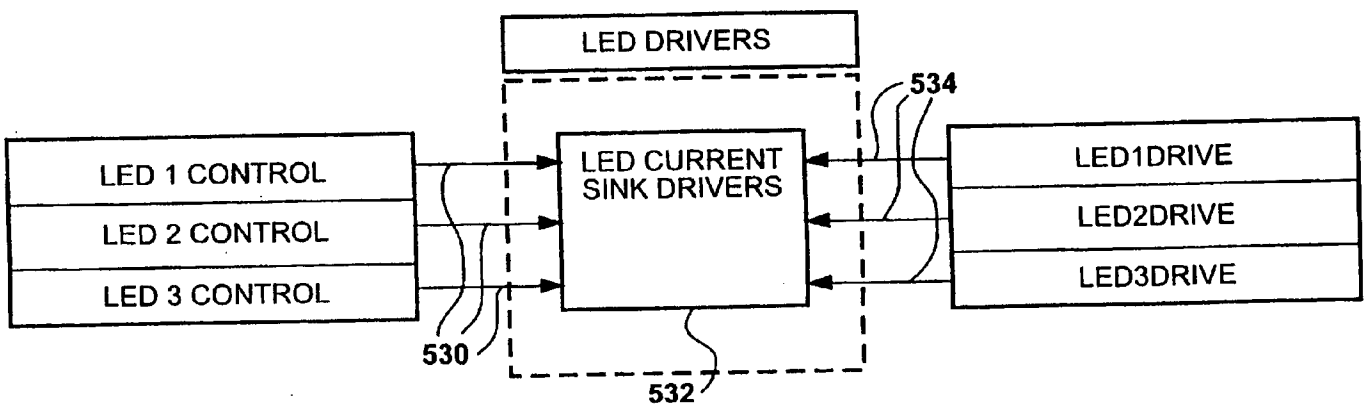
FIG. 27 is an electrical schematic view of the LED drivers module 328.
Figure 26:
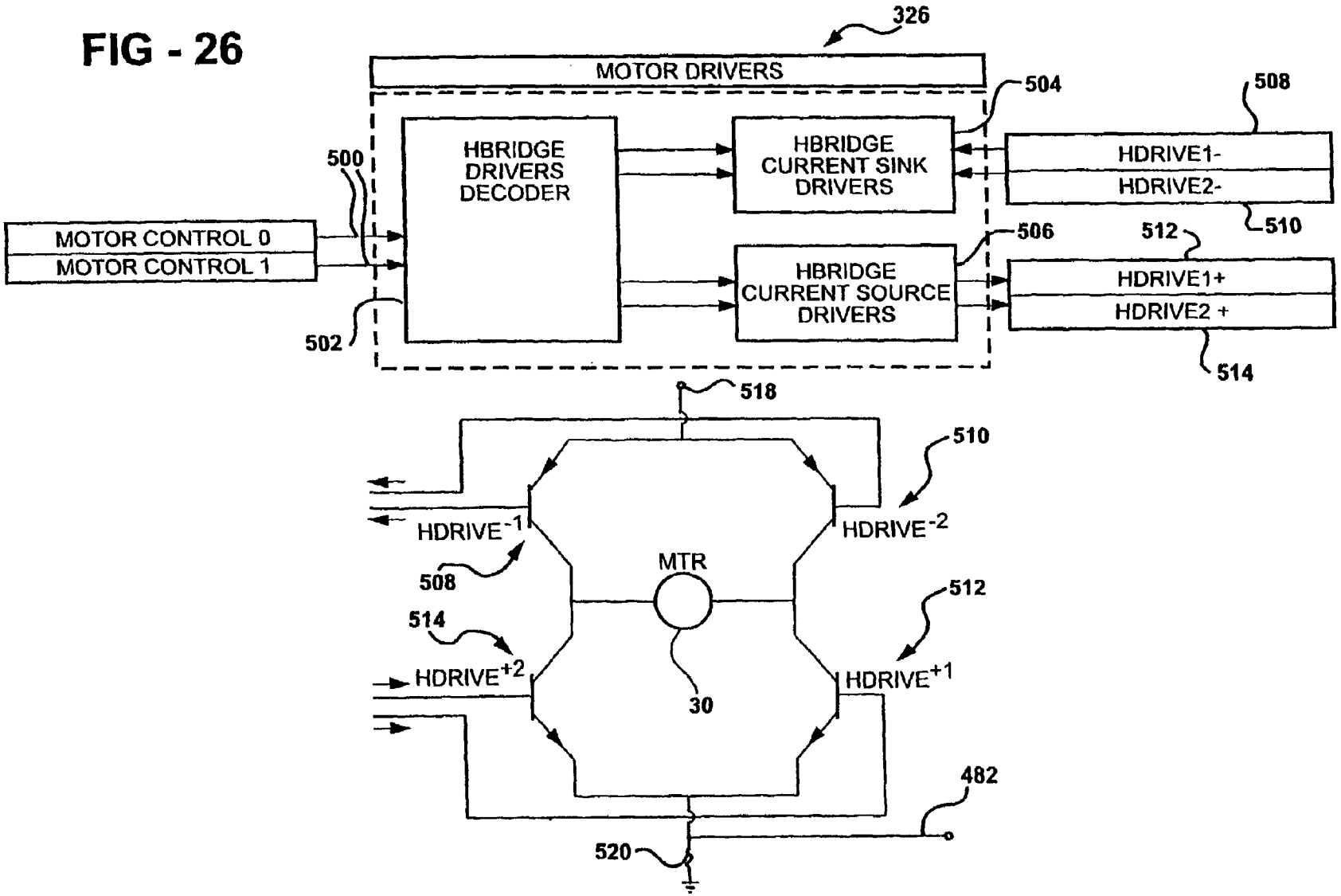
FIG. 26 is an electrical schematic view of the H-bridge motor driver module 326.

As seen in FIG. 27, LED driver 328 is also operative via a series of electrical current sink drivers, and is generally comprised of control inputs 530, current sink drivers 532, and terminals 534. Like the motor driver 326, the LED driver 328 receives control information from the first control register 448 of the special function registers 318, which causes the current sink drivers to turn on certain terminals. The particular current sink drivers, whose operation is controlled by the control register, drive the external LEDs of the LED display module 140. Again, it is important to note, the LED driver can deliver a constant current source to the LEDs, thereby achieving a constant brightness throughout the life of the battery.

Figure 28:
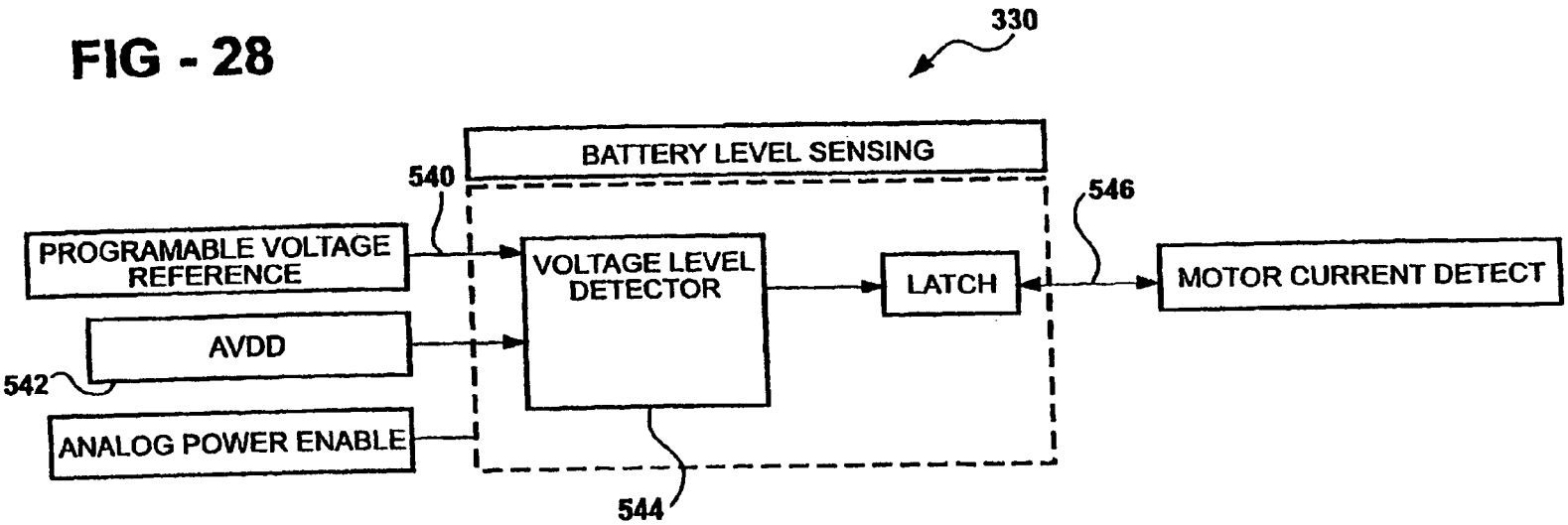
FIG. 28 is an electrical schematic view of the battery level sensing module 330.

The battery level sensing 330 is connected to the power control 322 and the special function registers 318, as seen in FIG. 28. The battery level sensing module uses the reference voltage provided by the power control 322 to determine the present battery power of the system and stores the result of that comparison in the status register 450. The battery level sensing module 330 generally includes a reference voltage input 540, a battery level input 542, a voltage level detector 544, and a battery level output 546. As seen with the motor current sensing module 324, the voltage level detector 544 will divide the battery level input signal 542 by a known factor such that the divided battery level signal and the reference voltage signal may be fed to an analog comparitor. An analog comparitor will compare the two signals and issue an output based on which signal is higher. Consequently, when the battery level falls to a level where the divided signal is lower than the reference voltage, the battery level output 546 will send a signal to a status register indicating the low battery level condition. This low battery condition may then be conveyed to an operator via yellow LED 156, as previously explained.

Figure 29:
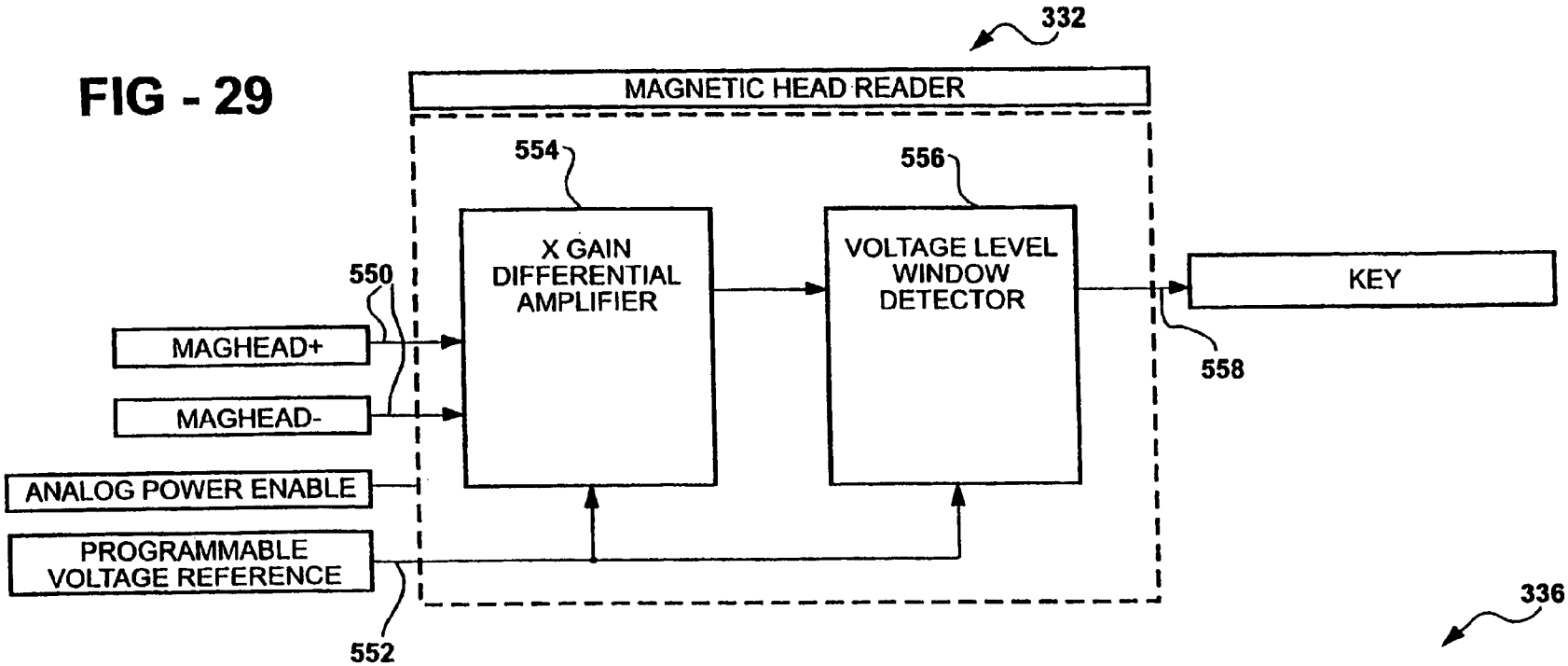
FIG. 29 is an electrical schematic view of the magnetic head reader module 332.

The magnetic head reader module 332 is used in conjunction with the external magnetic card reader assembly 138 and receives the magnetic information stored on the card and read by the magnetic card reader, as seen in FIG. 29. The magnetic reader module 332 is primarily comprised of maghead inputs 550, reference voltage source input 552, X-gain amplifier 554, voltage level detector 556, and level change output 558. The maghead inputs 550 are connected to the magnetic card reader assembly 138 and deliver the magnetic information stored on the card to the magnetic head reader 332. As seen with the motor current sensing 324 and the battery level sensing 330, the magnetic head reader module uses the reference voltage signal from the power control 322 as a frame of reference to which it compares the information from the magnetic card. The X-gain amplifier 554 is a software programmable amplifier and may therefore be adjusted according to the particular magnetic card reader used. To increase the noise immunity of the magnetic head reader, the voltage level detector 556 has programmable hysteresis. Therefore, when comparing the magnetic information to the reference voltage signal, small spikes in the signal will not be misinterpreted as a positive signal. It should be noted, the higher the gain of the amplifier, more hysteresis tolerance should be allowed. When the voltage level detector 556 detects a change of state in the magnetic input signal, it informs the core processor 340 which monitors for changes of magnetic signal states.

Figure 30:
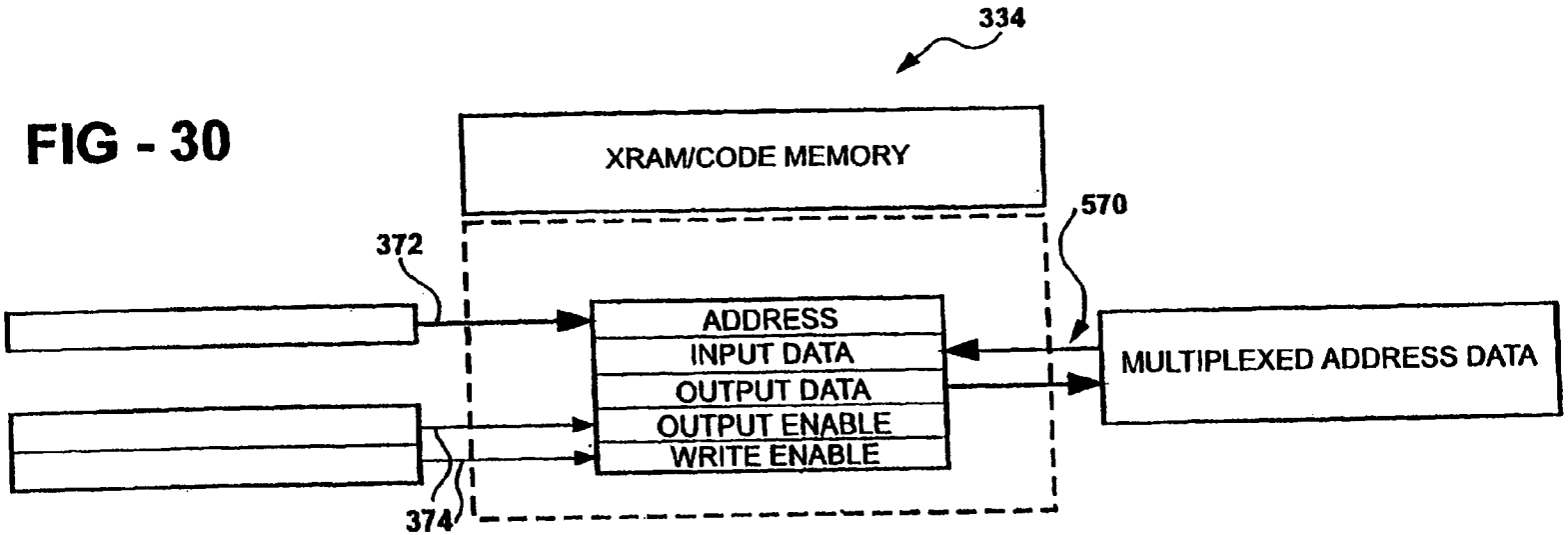
FIG. 30 is an electrical schematic view of the X-ram memory module 334.
Figure 31:
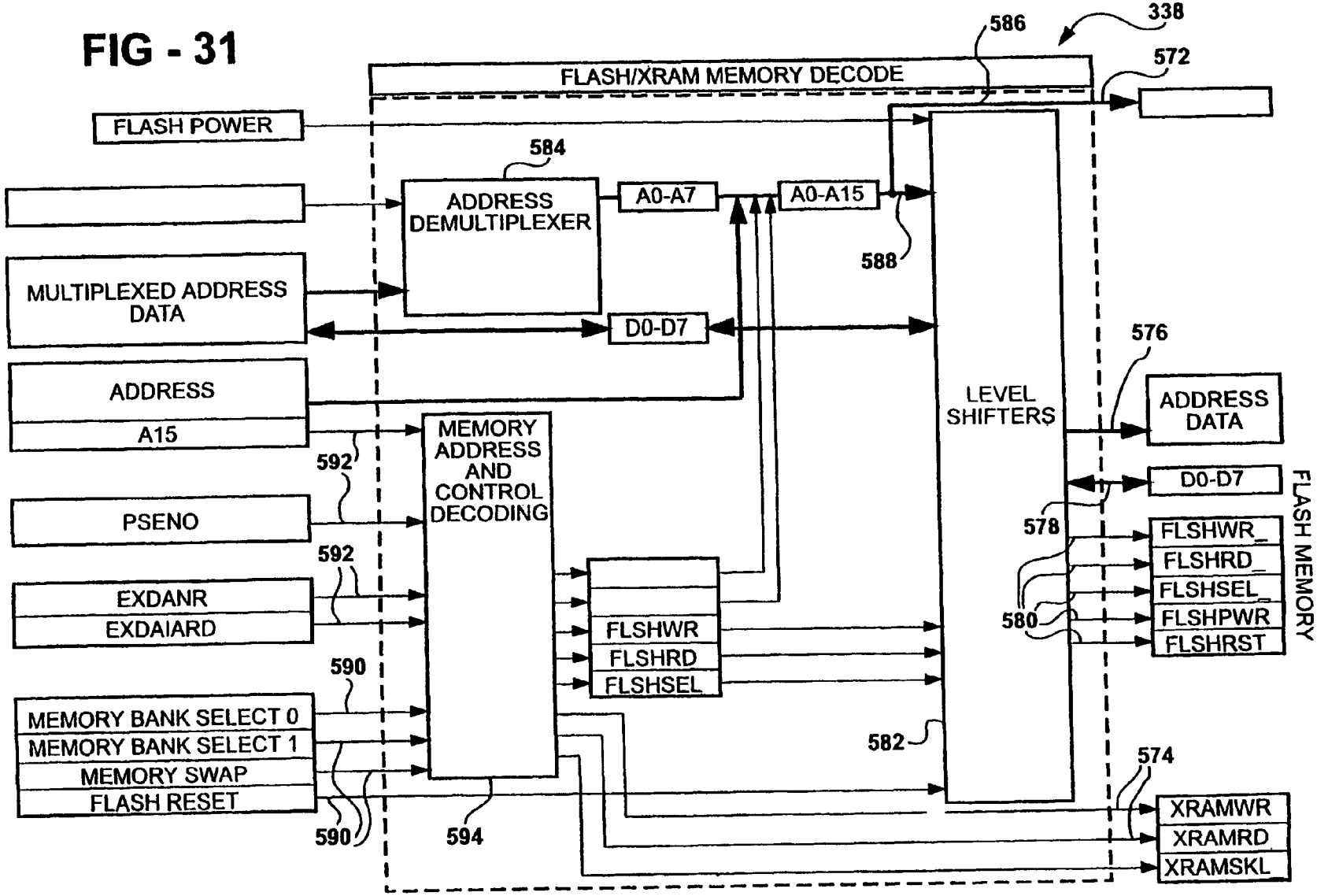
FIG. 31 is an electrical schematic view of the memory decode module 338.

There are two sources of writable memory internal to the lockset controller 28 and one source of memory external. Both the X-ram memory 334 and the scratchpad memory 336 are located on the lockset controller 28, while the flash memory is external. The X-ram and flash memory are best explained concurrently due to their interdependence with each other. Referring to FIG. 31, the flash memory is a 64 k byte EPROM which stores the main code for the core processor 340 and is connected to the memory decode 338 via control lines 580 and buses 576 and 578. Neither the flash memory nor the X-ram memory 334 can be simultaneously written to and read from. Therefore, when it is necessary to write information to the flash memory, the processor 340 must switch control from the flash to the X-ram memory, such that the processor is now receiving instructions from the X-ram and writing to the flash. A particular characteristic of the core processor 340 is that it has both a data read and write enable line, but only one program read enable line. All three enable lines are connected to both the flash and X-ram memories via the memory control decoder 594. When the processor is executing instructions from the flash, the memory control decoder connects the single program read enable signal to the flash and the two data enable signals, read and write, to the X-ram. When control is switched from the flash to the X-ram, the memory control decoder routes the two data enable signals to the flash and the single program enable signal to the X-ram. As will be subsequently described, signals to the flash memory must pass through level shifter 582 to ensure signal compatibility. In order to switch control from the flash to the X-ram, a pointer is placed in the code of the flash memory, such that the processor encounters it as it sequentially executes instructions. This pointer sends control to a 1 k bootstrap within the flash memory which has a swap instruction. The swap instruction transfers processor control from the external flash memory to the X-ram memory, where some instructions reside. It is necessary that the address of the swap instruction in the flash memory corresponds to the same address in the X-ram memory, due to the fact that the core processor 340 will receive its next instruction from the swap address +1. Now that control has switched to the internal X-ram memory 334, the processor 340 is free to write to the flash memory. The processor will continue to write to the flash until a swap command is encountered within the X-ram memory, at which time control will transfer back to the flash and execution will commence as before. As seen in FIG. 30, X-ram memory 334 communicates with the core processor 340 via a multiplexed address and data bus 570, and with the flash memory decode 338 via bus 572 and control lines 574. One of the control lines includes a write enable line that allows the X-ram to write to the flash, while the read enable permits the X-ram to read from the flash. As seen in FIG. 31, the flash memory decode 338 acts as an interface between the flash memory and the rest of the circuitry. Information is sent between the flash memory and the flash memory decode by way of an address bus 576, a data bus 578, and several control lines 580. The control lines will disable the flash memory when the lockset controller 28 is in sleep mode, and perform the previously mentioned data and program enable functions. As seen in the smart key control 314, level shifter 582 will adjust the voltage levels of the signals passing back in forth to the flash memory to ensure that they are compatible with the rest of the controller circuitry. Information on the data bus 578 is passed directly to the core processor 340 once it has been processed by the level shifter 582, and vice versa. Address information, however, is first generated by the core processor 340, passed through a demultiplexer 584, and then split into two identical branches. The first branch 586 is directly sent to the X-ram memory, the second branch 588 is sent to the flash memory, via the level shifter 582. The instruction located at that particular address will be retrieved from whichever memory source has the control.

Figure 32:
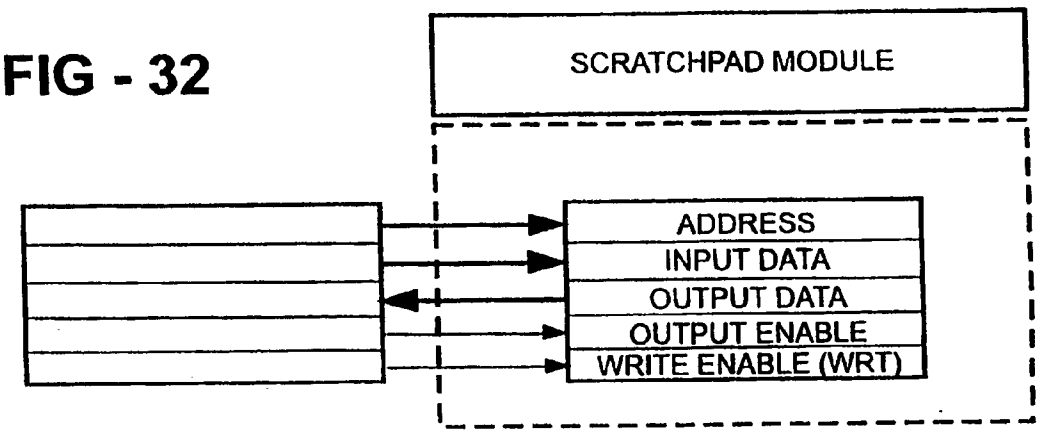
FIG. 32 is an electrical schematic view of the scratchpad memory module 336.

The scratchpad memory 336 seen in FIG. 32 stores the time register as well as all system variables. The scratchpad memory 336 communicates exclusively with the internal registers of the core processor 340 and is accessed through a single address bus, two data buses, and several control lines.

In operation, the lockset controller 28 is usually in a low power consuming sleep mode until awakened by one of several wakeup events, at which time the lockset controller begins an active mode which executes a series of instructions determined by the particular wakeup event which has occurred. During the active mode, the core processor 340 retrieves instructions stored in either the X-ram or flash memory as well as status information stored in the special function registers 318. Once the instructions and information is obtained, the core processor takes control of one or more devices located on or external to the lockset controller 28.

During the sleep mode, the low power oscillator 302 supplies a 32.768 kHz clock signal to several components and is the only device on the lockset controller 28 which is in active operation. There are several events that may bring the lockset controller 28 out of sleep mode and into the active mode, they include: a wakeup signal from the real time clock 304, activation of the smart card switch, activation of the deadbolt, microswitch 106, activation of the knob switch, activity on the serial port, or a signal from the IR receiver. All signals representative of these wakeup events, are channeled through the wakeup control 312, which acts as an interface between the wakeup devices and the core processor 340. As previously mentioned, the real time clock 304 acts as a programmable counter which periodically issues a wakeup signal based on a 32.768 kHz signal from the low power oscillator 302. As seen in FIG. 15, the real time clock receives a low frequency clock signal on one of the inputs 364, increments a counter register 360, and issues a wakeup signal on output 366 when the counter register reaches a certain, programmable value. Consequently, the real time clock 304 initiates a type of status check by waking the lockset controller 28 up every so often, even if there is no other activity throughout the lockset controller.

As previously mentioned, other events which can awake the lockset controller 28 include activation of a smart card switch and activation of deadbolt microswitch 106. These switches are electromechanical devices coupled to specific external components, such as the deadbolt 198 or the key card reader 26, and are electrically connected to the switch control 308 such that they inform the lockset controller 28 when there has been activation of these components, as previously explained. For example, a switch within the key card reader 26 informs the lockset controller 28 of the insertion of a smart key card, just as another switch indicates a change of the deadbolt position. The signals generated by these switches act as wakeup signals, just like the wakeup signal generated by the real time clock 304, and are received by the switch control 308. As seen in FIG. 17, input lines 390 receive signals from the switches, switch power control 392 alerts the switch debounce control 394 of a change in input state, switch debounce checks the signals to ensure their authenticity, and a wakeup control output line 398 issues a wakeup signal depending on which switch has been activated. Unlike the wakeup signal produced by the real time clock 304, the signals sent by the electromechanical switches may contain a lot of static and noise and therefore must be checked by switch control 308 before being sent as wakeup signals. Again, this conserves power consumption by decreasing the amount of noisy switch signals which are misinterpreted as wakeup signals and inadvertently wake the lockset controller 28 up out of low power consumption sleep mode.

Activity on the serial port control 310 may also bring the lockset controller 28 out of sleep mode. Activity on the serial port will alert wakeup control 312 over the serial receiver line, which is one of the inputs 380. Accordingly, if any external device, such as a lockset interrogator 212, is attempting to communicate with the lockset controller 28 via the serial port, the wakeup control module 312 will alert the necessary components of the lockset controller. Another potential wake up event is activity detected by the IR receiver. The IR receiver is located external to the lockset controller 28 and receives infrared signals. Upon reception of any IR signal, the IR receiver issues a wakeup request signal which, like the previous wake up signals, is sent to the edge detector 382 via inputs 380. Once the edge detector sees a rising or falling edge sufficient to indicate a change in the state of the signal, the wakeup control 312 wakes up the core processor 340 and resets certain registers. It should be noted, the wakeup control will not reset the core processor 340 if the processor is already awake.

After the processor 340 receives a wakeup signal, it informs the high speed oscillator 306 that it is awake which in turn provides the processor 340 with a high speed clock signal. As seen in FIG. 16, the oscillator enable input 372 allows the high speed oscillator to multiply the slower clock signal and thereby provide the processor 340 with a fast clock signal more conducive to the active mode.

If the real time clock 304 produced the wakeup signal which brought the processor into operational mode, the processor 340 performs a series of status checking functions. These functions may include checking the status of the various switches, the battery level, lock malfunctions, or any other function requiring a periodic check. Upon performing status checking finctions, the processor 340 updates the special function registers 318 to record any changes in the status of the lockset controller 28, as well as potentially activating an external device, such as the LED display 140, of any potential problems.

If the processor 340 has been awakened by the activation of the smart card switch, the processor uses the smart key control 314 to communicate with the smart key card via the serial port. As previously mentioned, the processor may write information to or read information from the smart key card via the smart card key control 314 and serial port. Such information could include writing to the smart key card the number of times that particular lock has been unlocked, the number of times that particular key has been inserted into that lock, or any other event worth recording. If the smart key card is correctly configured for that particular lock, the processor 340 instructs the motor drivers 326 to drive the electric motor 30 accordingly.

Upon such an instruction, motor control signals are sent to the motor drivers 326 via inputs 500. These inputs are decoded by the H-bridge decoder 502 and thereafter instruct the current sink and source drivers to turn on the appropriate transistors. As previously explained, this allows the processor to dictate in which direction the lock motor 30 operates and consequently can determine if the locking mechanism 22 is engaged or unengaged. To determine when the locking or unlocking operation is complete, the current sensing module 324 monitors the current through the motor 30 via the voltage across a resistor 520 and compares the current against a "baseline" reference current. When the motor 30 is rotated such that the locking mechanism cannot be extended further, the clutch 48 slips or "hops", thereby causing a spike in the current in relation to the baseline current. As baseline current draws vary between motors and depend on a number of additional factors including temperature, the lockset controller 28 is programmed to establish a new baseline current value each time the motor 30 is energized.

It is important to note however, in addition to sensing the amount of electrical current which is being sent to the motor 30, the motor drivers 326 draw upon tabulated data to set a minimum and maximum duration for powering the motor. In this manner, if the current sensing module 324 determines that the locking mechanism has reached an obstruction before the predetermined minimum duration, the processor 340 will continue to power the motor 30 until that minimum time is reached. Likewise, if the maximum time duration is reached before the current sensing module 324 indicates that the lock has reached a final position, the processor 340 will instruct the motor drivers 326 to stop powering the motor. The minimum run time typically corresponds to a value that is at least marginally longer than the amount of time normally required to move the sliding stop 34 into engagement with the handle hub 16. This excess run time ensures that the sliding stop 34 fully engages the complementary recess in the hub 16 under adverse conditions such as increased friction due to lack of lubrication, contamination, component wear, etc. The maximum motor run time may be established as a function of battery charge level, i.e., the amount of voltage remaining in the four batteries that power the motor 30. The lockset controller 28 senses the battery voltage and limits the motor run time accordingly. If the battery charge level is relatively high, the maximum motor run time is set to a relatively high value. If battery charge level is relatively low, the maximum motor run time will be proportionally reduced to extend the life of the battery. Attentively, the maximum and minimum motor run times may be established by using an algorithm or other acceptable means.

Activation of the smart card switch may also prompt the processor to engage the magnetic head reader 138, as a magnetic strip and smart key card are both read from the same external slot. Again, the processor 340 might engage the motor drivers 326 if the information on the magnetic strip is so configured.

The lockset controller 28 may further include a "hassle" feature that prompts the user to take notice of any fault indication that might be displayed on the LED display module 140. The lockset controller is configured to detect lock malfunctions and to illuminate a red fault indicator LED 96 in response to such lockset apparatus malfunctions. Under normal operation, the lockset controller reverses the motor 30 and retracts the sliding stop 34 in response to a single key card insertion, assuming of course that the key card includes the correct code for entry. However, if a lockset apparatus malfunction is detected, the lockset controller 28 reverses the motor 30 and causes the sliding stop 34 to retract from the handle hub 16 only after the second of two key card insertions made within a predetermined time period. This "hassle feature" prompts the user to notice and attend to lockset apparatus malfunctions indicated by the red LED malfunction indicator light 96. In other words, the hassle feature prompts certain users which the lockset controller 28 identifies by the configuration of their key cards, to notice a fault indication by requiring two insertions of a key card before reversing the motor 30 and unlocking the hub 16. Preferably, the lockset controller 28 is programmed to notify only those responsible for attending to such malfunctions such as the holders of master key cards.

The electronic mortise lockset apparatus 10 also includes an employee access tracking system that allows employers to determine which rooms, in an establishment such as a hotel or office building, each of their employees have gained access to or attempted to gain access to, and at what times. The method includes installing electronic mortise locksets 10, of the type described above, in the doors to various rooms of the establishment. As with the lockset described above, each of these locksets includes a latch bolt 14 retractable by the turning of a door handle 18 operably connected to the latch bolt 14. Each lockset also includes a lockout mechanism 22 that prevents the handle 18 from being turned when the lockout mechanism 22 is in an engaged position. Each of the installed locksets also includes a key card reader module 26 that identifies properly configured "smart" key cards and a lockset controller 28 that commands the lockout mechanism 22 to disengage when the key card reader module 26 identifies a properly configured key card.

To employ the tracking system, each of a number of different key card users (employees) are provided with a "smart" key card that, as described above, includes a processor, RAM, and ROM. In addition, each lockset controller 28 is programmed to upload a first set of access data to the RAM of the "smart" key card whenever that key card is used to unlock the electronic mortise lockset 10. This first set of access data includes a door identification number assigned to the door that the lockset is mounted in and the time and date that the card was inserted into the card reader module 26. The "smart" key cards distributed to employees would each include a revolving memory that remembers approximately the last 500 lock insertions.

At the same time that the first set of access data is uploaded to the key card RAM, a second set of access data is downloaded to the memory of the lockset apparatus. This second set of access data includes an identification number assigned to the key card and the time and date that the card was inserted into the card reader module 26.

The lockset controller 28 will not power up the motor 30 to unlock the lockout mechanism 22 until after writing the access data to the key card and lock RAM. This prevents a user from unlocking the door then quickly withdrawing his or her key card before access data can be written.

After issuing the "smart" key cards to the users, the key card users are then permitted to go about their business on the premises using their key cards to gain entry to various rooms on the premises, unlocking the locksets by inserting the key cards into the key readers of the locksets. Each time a key card user inserts one of the key cards into one of the locksets, the lockset that the key card is inserted into automatically writes the access data from the lockset controller 28 to the key card memory and the lock memory as described above. Because the first set of access data downloaded to each key card includes a record of the time that the key was inserted into that lockset, each key card maintains an accurate and comprehensive record of which locksets/doors that card holder unlocked and when.

At the end of each workday each user's key card is inserted into a separate key card reader module connected to a microcomputer programmed to compile key card access information. The microcomputer is programmed to display or print-out a report that identifies which locksets each key holder opened and at what times. In this way, an employer can easily determine which rooms each of his employees gained access to through the day and the times that each employee gained access to those rooms. This method obviates the need to travel throughout the premises downloading access data from each lock separately. However, the access data can be downloaded from lockset memory to confirm data downloaded from key card RAM.

There are numerous sequences of events which could occur as the result of a wakeup signal originating from either a component within the lockset controller or external to it. It should be noted, that the particular response to the individual wake up events is software programmable and resides in the code of the system.

In alternative embodiments, the key card reader module 26 may include any suitable key card reading device to include one that is configured to receive and read a memory card rather than a "smart" card—or that is configured to receive and read either a memory card or a "smart" card. (A memory card is different from a smart card in that it does not include either RAM or a processor.) In this case, a properly configured key card would include a predetermined program code that the key card reader module 26 would download data from. However, the key card reader module 26 would not upload data to the card.

In still other embodiments the key card reading device may be an optical scanner configured to read bar code patterns. In this case, a properly configured key card would include a predetermined bar code pattern readable by such an optical scanner.

The advanced design of an electronic mortise lockset apparatus 10 constructed according to the invention provides a number of advantages over prior art systems. The lockset controller 28, programmed as described, can both extend battery life by limiting motor run time and can help to insure full lockout mechanism engagement. By holding the sliding stop 34 in engagement with the handle hub 16, the lockout mechanism 22 insures that the lockset remains securely locked even when subjected to significant shock and vibration. The components of the lockset apparatus 10 are easy to assemble and disassemble for ease of service and/or modification. The lockset apparatus 10 is sturdy enough to survive a tremendous amount of torque applied to the door handle 18. All the components of the lockset are internally mounted in the lockset case 12 to preclude exposure to corrosive environmental effects. The slip clutch 48 of the lockout mechanism 22 prevents motor 30 damage that might otherwise result from stalling of the motor 30 caused by jamming, obstructions, or increased resistance to an application of force to the handle 18 during motor 30 operation. The gearbox 32 of the lockout mechanism 22 provides low cam rotation speed while allowing the motor 30 to run at high speed. High motor 30 speed provides more torque and helps keep motor 30 brushes clean. Mounting the microswitch 106 of the deadbolt position indicator on the motherboard 78 is a lower cost alternative to mounting the microswitch 106 at the end of the harness wire in a remote location.

I intend this description to illustrate certain embodiments of the invention rather than to limit the invention. Therefore I have used descriptive words rather than limiting words. Obviously, it is possible to modify this invention from what the description teaches. Within the scope of the claims one may practice the invention other than as described.

What is claimed is:

1. A mortise lockset apparatus (10) for a door mounted in a door frame, the apparatus comprising:

a case (12) configured to fit into a complementary cavity in a door;

a retractable bolt (14) movably supported within the case, a portion of the bolt extending from the case in an extended position and withdrawn into the case in a retracted position, the bolt configured to engage a complementary recess formed in a door frame when the bolt is in the extended position and the door is in a closed position with the bolt axially aligned with the recess;

a handle (18) pivotally and rotatably mounted on a hub (16) supported in the case (12), the hub being operably connected to the retractable bolt, the bolt being retractable from the extended position by turning the door handle;

a handle lock-out mechanism (22) supported in the case and configured to prevent the handle from being turned when the lock-out mechanism is in an engaged position;

a key reader (26) supported adjacent the case and connected to the lock-out mechanism, the key reader configured to identify properly configured keys;

a lockset controller (28) connected to the lock-out mechanism and the key reader, the lockset controller configured to disengage the handle lock-out mechanism when the key reader identifies a properly configured key; the handle lock-out mechanism including:

a cam (29) movably supported in the case and operably connected to a motor (30), a sliding stop (34) movably supported in the case and including a first end (36) engageable with the handle hub to prevent the handle hub and the handle from turning, the sliding stop including a bearing surface (38) engageable with a cam surface (40) of the cam, the cam surface being disposed adjacent the bearing surface of the sliding stop in a position to move the sliding stop (34) into engagement in the hub when the motor moves the cam, to lock the hub in place, the motor configured to move the cam surface about a cam axis, the cam rotatably supported in the case about the cam axis (42), the cam axis disposed between diametrically opposed portions of the cam surface; and a slip clutch (48) disposed between the motor (30) and the cam surface (40) and configured to allow the motor to continue running after the sliding stop has been driven to the full extent of its travel into the hub.

2. A mortise lockset apparatus (10) as defined in claim 1 in which the slip clutch (48) of the lock-out mechanism (22) is disposed between diametrically opposed portions of the cam surface (40) to minimize space requirements for the assembly in the case (12).

3. A mortise lockset apparatus (10) as defined in claim 1 in which the lock-out mechanism (22) includes a motor controller (326) configured to run the motor (30) longer than is normally required to move the sliding stop (34) into engagement with the hub (16) to ensure that the sliding stop is fully engaged in the hub.

4. A mortise lockset apparatus (10) as defined in claim 3 in which the motor controller (326) is configured to control motor run time as a function of battery charge level, the motor controller configured to sense battery voltage in the battery that powers the motor (30) and to limit motor run time in response to battery low voltage conditions, the motor controller configured to calculate a minimum motor run time as a function of the amount of voltage remaining in a battery.

5. A mortise lockset apparatus (10) as defined in claim 1 in which the lock-out mechanism (22) includes a current increase sensor (324) connected to the motor controller (326) and configured to sense a current increase when the clutch (48) slips, the motor controller configured to stop the motor (30) when the motor controller senses the current increase.

6. A mortise lockset apparatus (10) as defined in claim 1 in which the lock-out mechanism (22) includes a spring (80) configured to store energy when the sliding stop (34) is either blocked or hung up by friction as it is being moved, the spring being configured to move the sliding stop into the commanded position when the blockage or hangup is overcome.

7. A mortise lockset apparatus (10) as defined in claim 1 in which the lock-out mechanism (22) includes a reversible hub (16) configured to be axially reversed.

8. A mortise lockset apparatus (10) as defined in claim 1 in which the lockset controller is further configured to detect lock malfunctions and to require two key insertions before moving the lock-out mechanism out of the engaged position when the lockset controller has detected a lock malfunction.

9. A mortise lockset apparatus (10) as defined in claim 8 in which:

the lockset controller (28) is connected to the motor controller (326); and the lockset controller signals the motor controller to actuate the motor (30) to retract the sliding stop (34) from the hub (16) in response to the second of two key insertions within a predetermined time period when the lockset controller detects a lock malfunction.

10. A mortise lockset apparatus (10) as defined in claim 8 in which:

the lockset includes a display panel (140) connected to the lockset controller (28);

the lockset controller is configured to display a code on the display panel that identifies the lock malfunction.

11. A mortise lockset apparatus (10) as defined in claim 1 and further comprising:

a lever (100) pivotally supported on a spindle (104) supported in the case, the spindle being operably connected to the retractable dead bolt, the dead bolt being retractable from the extended position by turning the lever;

a dead bolt position indicator including a microswitch (106) mounted on a printed circuit card (78) and actuated by contact with the spindle as the spindle is rotated, the microswitch configured to transmit dead bolt position information to the lockset controller, the dead bolt position indicator further including a cam (110) supported on the spindle and configured to mechanically actuate the microswitch when the dead bolt moves into or out of its engaged position.

12. A mortise lockset apparatus (10) as defined in claim 11 in which the logic circuitry of the lockset controller (28) is disposed on the printed circuit card (78).

13. A mortise lockset apparatus (10) as defined in claim 1 and further comprising:

lock mounting fasteners (124) that connect an inner portion of the lock disposed on an inner side of the door to an outer portion of the lock disposed on an outer side of the door, the inner portion of the lock covering the complementary cavity; and a washer plate (126) disposed on the inner side of the door between the inner portion of the lock and a head portion of each lock mounting fastener, the washer plate including openings (128) for receiving respective shaft portions of each fastener, the openings being smaller than the head portions of the fasteners, the washer plate comprising a material relatively more fire resistant than the outer portion of the lock.

14. A mortise lockset apparatus as defined in claim 1 in which the key reader module includes an upper module component (132) defining an upper wall of a key receptacle (134), a lower module component (136) connected to the upper module component and defining a lower wall of a key receptacle, and snap-lock detents (144) supported on at least one of the upper and lower module components and configured to connect the upper and lower module components together by snap-fit engagement.

15. A mortise lockset apparatus (10) as defined in claim 14 in which the key reader module (26) comprises an LED bar (140) configured to display information related to lock operation.

16. A mortise lockset apparatus (10) as defined in claim 15 in which snap-lock detents (144) are supported on at least one of the upper and lower module components (132, 136) and the LED bar (140) and are configured to connect the LED bar to one of the upper and lower module components by snap-fit engagement.

17. A mortise lockset apparatus (10) as defined in claim 16 in which the LED bar (140) is configured to clamp a flex cable (142) in place when the LED bar is snapped into position on the module.

18. A mortise lockset apparatus (10) as defined in claim 14 in which the key reader module (26) is configured to read magnetic strips affixed to key cards.

19. A mortise lockset apparatus (10) as defined in claim 1 in which the key reader comprises a read head bracket assembly (138) including a magnetic read head (180) configured to read magnetic strips affixed to key cards, and a biasing spring (188) that biases the magnetic read head in such a way as to hold the read head bracket assembly together.

20. A mortise lockset apparatus (10) as defined in claim 19 in which a leg (190) of the key reader biasing spring (188) is positioned to touch a grounded metal portion of the lockset to provide ground for the read head (180).

21. A mortise lockset apparatus (10) as defined in claim 14 in which the key reader module (26) is configured to read bar code symbols printed on key cards.

22. A mortise lockset apparatus (10) as defined in claim 14 in which the key reader module (26) is configured to communicate with integrated circuit chips (IC chips) embedded on key cards.

* * * * *

UNITED STATES PATENT AND TRADEMARK OFFICE

CERTIFICATE OF CORRECTION

PATENT NO. : 7,051,561 B2
APPLICATION NO. : 10/343553
DATED : May 30, 2006
INVENTOR(S) : Charles W. Moon et al.

It is certified that error appears in the above-identified patent and that said Letters Patent is hereby corrected as shown below:

Column 3, line 63, at "sliding stop is frilly", delete "frilly", insert --fully--;
Column 24, line 54, at "battery. Attentively", delete "Attentively", insert --Alternatively--.

Signed and Sealed this

Fourteenth Day of November, 2006

JON W. DUDAS
*Director of the United States Patent and Trademark Office*